US012121202B2

(12) United States Patent
Patel

(10) Patent No.: US 12,121,202 B2
(45) Date of Patent: Oct. 22, 2024

(54) CLEANING DEVICE

(71) Applicant: UPROOT LINT LLC, Miami, FL (US)

(72) Inventor: Mehul Patel, Miami, FL (US)

(73) Assignee: Uproot Lint LLC, Miami, FL (US)

( * ) Notice: Subject to any disclaimer, the term of this patent is extended or adjusted under 35 U.S.C. 154(b) by 0 days.

(21) Appl. No.: 18/234,135

(22) Filed: Aug. 15, 2023

(65) Prior Publication Data

US 2024/0049930 A1 Feb. 15, 2024

Related U.S. Application Data

(63) Continuation-in-part of application No. 18/220,210, filed on Jul. 10, 2023.

(60) Provisional application No. 63/397,933, filed on Aug. 15, 2022.

(51) Int. Cl.
*A47L 9/06* (2006.01)
*A47L 13/02* (2006.01)

(52) U.S. Cl.
CPC ..... *A47L 9/0613* (2013.01); *A47L 13/02* (2013.01)

(58) Field of Classification Search
CPC ..... A47L 9/0613; A47L 13/02; A47L 13/022; A47L 13/36; A47L 13/38
USPC ..... 15/142, 186, 236.08, 246.2; 30/169
See application file for complete search history.

(56) References Cited

U.S. PATENT DOCUMENTS 3,363,276 A 1/1968 Thomas, Jr.
3,624,855 A * 12/1971 Shaw ..... A47L 13/12 15/118
D241,008 S 8/1976 Di Loreto
4,006,599 A 2/1977 Hegler
(Continued)

FOREIGN PATENT DOCUMENTS

EM 007383278-0001 1/2020
GB 2428964 A * 2/2007 ..... A47L 13/08
GB 6125931 3/2021

OTHER PUBLICATIONS

JXMORE Mega (XXL) Size Portable Pet Hair Remover and Carpet Lint; https://www.amazon.com/JXMORE-Portable-Remover-Carpet-Cleaner/dp/B09PFR6HLT/ref=sr_1_127?crid=2TQMJLKP8RCAL&keywords=carpet%2Brake%2Bpet%2Bhair%2Bblade&qid=1699477899&sprefix=carpet%2Brake%2Bpet%2Bhair%2Bblade%2Caps%2C142&sr=8-127&th=1 (Year: 2022).*
(Continued)

*Primary Examiner* — Eric J Rosen
*Assistant Examiner* — Aaron R McConnell
(74) *Attorney, Agent, or Firm* — John H. Choi & Associates

(57) ABSTRACT

A cleaning device includes a base member extending with a first distal end and a first proximal end. The first proximal end is at an angle relative to the first distal end. A support member extends between a second distal end and a second proximal end. At least one support flange couples the base member and the support member. An extension member extends from the second distal end. At least one teeth member comprises a contact surface and an attachment surface. The attachment surface is formed with an inner channel, and the inner channel is coupled with one of the first distal and proximal ends. The contact surface has outer flanges with an outer channel formed therein. The contact
(Continued)

surface is adapted to come in contact with a cleaning surface such that the outer flanges penetrate the cleaning surface to dislodge and collect debris.

20 Claims, 26 Drawing Sheets

(56) References Cited

U.S. PATENT DOCUMENTS

| | | | | | |
|---|---|---|---|---|---|
| D262,671 | S | * | 1/1982 | Erickson | D4/136 |
| 4,884,312 | A | * | 12/1989 | Clark | E04F 21/06 264/273 |
| D325,486 | S | | 4/1992 | Goldstein | |
| D349,592 | S | | 8/1994 | Stoll | |
| D373,661 | S | | 9/1996 | Watson | |
| D383,611 | S | | 9/1997 | Tsai | |
| 5,784,756 | A | | 7/1998 | Slocum | |
| 5,983,431 | A | * | 11/1999 | Meshulam | E04H 4/1609 15/246 |
| D443,344 | S | | 6/2001 | Evans | |
| D500,644 | S | | 1/2005 | Cavanaugh | |
| D531,708 | S | | 11/2006 | Wagner | |
| 7,509,926 | B2 | | 3/2009 | Porter | |
| D611,576 | S | | 3/2010 | Tokuno | |
| D620,644 | S | | 7/2010 | Lau | |
| 7,748,350 | B2 | | 7/2010 | Vandervoet | |
| D622,467 | S | * | 8/2010 | Martin | D32/40 |
| D642,740 | S | | 8/2011 | Chiodo et al. | |
| D645,664 | S | | 9/2011 | Pires et al. | |
| D654,697 | S | * | 2/2012 | Ross | D4/116 |
| D670,057 | S | | 10/2012 | DiMauro | |
| D672,923 | S | | 12/2012 | Loudenback | |
| D672,924 | S | | 12/2012 | Amice | |
| 8,375,510 | B2 | | 2/2013 | Dyson | |
| D691,709 | S | | 10/2013 | Franzino | |
| 8,960,129 | B2 | | 2/2015 | Porter | |
| 9,060,496 | B2 | | 6/2015 | Porter | |
| D739,986 | S | | 9/2015 | Sullivan | |
| D743,132 | S | | 11/2015 | Kim | |
| D743,657 | S | | 11/2015 | Kim | |
| D753,358 | S | | 4/2016 | Kim | |
| D753,477 | S | | 4/2016 | Jackson | |
| 9,301,499 | B2 | | 4/2016 | Holt, Jr. | |
| D779,135 | S | | 2/2017 | Chang | |
| D783,785 | S | | 4/2017 | Bates-Hurtado | |
| D844,261 | S | | 3/2019 | Agtual | |
| 10,357,021 | B1 | | 7/2019 | Agtual | |
| D889,851 | S | | 7/2020 | Lei | |
| D898,283 | S | | 10/2020 | Stowers | |
| D898,302 | S | | 10/2020 | Zhang | |
| D899,713 | S | | 10/2020 | Lu | |
| D902,502 | S | | 11/2020 | Favia | |
| D905,354 | S | | 12/2020 | Favia et al. | |
| D905,916 | S | | 12/2020 | Favia et al. | |
| D910,246 | S | | 2/2021 | Zhang | |
| D932,714 | S | | 10/2021 | Favia et al. | |
| D932,715 | S | | 10/2021 | Favia et al. | |
| 11,147,239 | B2 | | 10/2021 | Porter et al. | |
| D942,711 | S | | 2/2022 | Zhang | |
| D953,660 | S | | 5/2022 | Favia | |
| D954,361 | S | | 6/2022 | Cafasso et al. | |
| D959,763 | S | | 8/2022 | Yan | |
| D962,561 | S | | 8/2022 | Zhu | |
| D968,045 | S | | 10/2022 | Chen | |
| D971,615 | S | | 12/2022 | Wang | |
| D978,198 | S | | 2/2023 | Lee | |
| D979,873 | S | | 2/2023 | Patel | |
| D980,553 | S | | 3/2023 | Cao | |
| D980,569 | S | | 3/2023 | Patel | |
| D980,570 | S | | 3/2023 | Patel | |
| 2004/0087973 | A1 | | 5/2004 | Shobeiri | |
| 2006/0200926 | A1 | * | 9/2006 | Graham | A47L 25/08 15/104.001 |
| 2007/0033758 | A1 | | 2/2007 | Wang | |
| 2007/0193529 | A1 | | 8/2007 | Vandervoet | |
| 2008/0078333 | A1 | | 4/2008 | Wang | |
| 2012/0304938 | A1 | | 12/2012 | Wang | |
| 2018/0288969 | A1 | | 10/2018 | Freidell | |
| 2021/0022580 | A1 | | 1/2021 | Hamilton | |
| 2022/0361447 | A1 | | 11/2022 | Mahtani | |

OTHER PUBLICATIONS

Lillie' Reviews, Eco friendly Portable Lint Remover reviews / How to use Lint Remover ?, Dec. 6, 2019, https://www.youtube.com/watch?v=7R29jse4zAA.

Shri Gloria, Portable Lint Remover Review / Does is really work ?, Jan. 1, 2020, https://www.youtube.com/watch?v=8HScypi2J-w.

Commonlee, Portable Lint Remover Review 2020—Does It Work?, Dec. 5, 2019, https://www.youtube.com/watch?v=WY2nZ45LgqY&t=4s.

Seniorgg Tool, Portable Lint Remover, Oct. 16, 2019, https://www.facebook.com/364456337730063/ posts/501314810710881.

Kidsman House, Portable Lint Remover, Oct. 16, 2019, https://www.facebook.com/2127638837272667/posts/2435470573156157.

Zemmo.Shop, Portable Lint Remover, Oct. 22, 2019, https://www.facebook.com/627886544376478/posts/709556886209443.

Mohaul Shop, Portable Lint Remover Clothes Fuzz Shaver restores your clothes and fabrics to a fresh new look!, Oct. 17, 2019, https://www.facebook.com/304196193832101/posts/408855190032867.

Shiny Pet, Undercoate Rake for Dogs & Cats—Double Sided Comb for Detangling and Removing Knots—2 Sided Dematting Tool—Deshedding Brush for Grooming Pets with Long Hair Prone to Matting —Ebook Guide, www.amazon.com.

VKY Technologies, Wooflix Professional Dematting Deshedding Comb Tool for Pet Grooming (Puppy Puppies Dog & Cat) Gentle Hair Brushes . . . , www.amazon.in, printed on Jan. 8, 2022.

WIPO, ISA/US, International Search Report and Written Opinion in Int'l App. No. PCT/US23/30253, Mar. 13, 2024.

* cited by examiner

CLEANING DEVICE

CROSS-REFERENCE TO RELATED APPLICATIONS

The present application claims priority to U.S. Provisional Application No. 63/397,933 titled "Cleaning Device," filed on Aug. 15, 2022, and U.S. Non-Provisional application Ser. No. 18/220,210 titled "Cleaning Device," filed on Jul. 10, 7023, which are incorporated by reference in their entireties.

FIELD

The present invention relates to cleaning devices, and in particular to a cleaning device with teeth members for improved cleaning.

BACKGROUND

Many types of cleaning devices exist for different purposes. Some examples include: brooms, which are normally used to sweep hard surfaces; mops, which are used to wipe down hard surfaces; vacuum cleaners, which are used to clean different types of surfaces by using suction; and lint lifters, which are used to remove lint and hair from surfaces using an adhesive.

While each of the above-mentioned cleaning devices may generally serve its intended purpose, it is difficult to find a cleaning device that is able to remove small fibrous debris such as pet hair, human hair and lint lodged within a fibrous surface. For example, surfaces of clothing, carpet, furniture, car seats, car mats and door mats include a depth in which such light fibrous debris could be entangled and lodged. Such fibrous debris is hard to remove even with a vacuum cleaner because the debris is lodged deep into the surface and within the fibers of the surface. Prior art vacuum cleaners and vacuum cleaner attachments for cleaning fibrous surfaces only include bristles to aid in dislodging debris from the surface, but they are ineffective.

Also, pets that shed hair, such as cats and dogs, tend to shed hair in the house, which requires the homeowner to constantly clean pet hair that is shed. While hairbrushes are available to collect hair directly from the pet, this requires cleaning of the brush after use and cleaning dislodged hair from the pet's surroundings, which is messy and time consuming.

Thus, a need exists for a simple and affordable cleaning device that can efficiently remove light fibrous debris from fibrous surfaces, as a stand-alone device or an attachment for vacuum cleaners.

Rapid urbanization and increasing industrialization have also resulted in a substantial increase in constructional activities. Accumulation of dust and debris generated from such constructional activities in living spaces is the leading cause for health-related issues, thereby prompting frequent cleaning of living spaces and workspaces. In such scenarios, use of vacuum cleaning machines in households has become quite common almost everywhere.

Typically, a vacuum cleaner is an electrically driven device that causes suction in order to remove dust and debris from surfaces such as floors, upholstery, draperies, and other surfaces or varying materials. Vacuum cleaners, which are used in homes as well as in industry, exist in a variety of sizes and shapes, from battery powered hand-held devices to bigger wheel-driven types. A vacuum cleaner generates a negative pressure to build partial vacuum so as to collect dust and dirt from floors and other surfaces, as well as fibrous debris such Lint, hair and the like.

However, when cleaning fibrous materials such as carpets and rugs, ordinary vacuum cleaners are unable to remove debris lodged deep into the fibrous material under the top surface of the area or object intended to be cleaned. For example, clothing, carpet, furniture, car seats, car mats and door mats include a depth in which such light fibrous debris could be entangled and lodged below the top surface. Such fibrous debris is hard to remove even with a vacuum cleaner because the debris is lodged deep into the material and within the fibers of the material being cleaned.

As such, various attachments are provided for attaching to the vacuum cleaner to not only clean smaller areas or hard to reach areas such as under furniture or inside an automobile, but also to aid in dislodging and removing debris from deep into fibrous material and within the fibers of the material. However, conventional attachments for cleaning fibrous surfaces only include bristles to aid in dislodging debris from the material, but they are ineffective.

Certain conventional arts also provide lint lifters attached to the suction head of the vacuum cleaner to remove lint and hair from fibrous materials. These lint lifters have an adhesive effect which catches lint and hair from only the top surfaces of the fibrous materials. As a result, debris lodged below the top surface remains lodged therein.

With the vacuum attachments described above, debris also tends to accumulate at the entry point of the attachment, thus not only restricting suction but also requiring the user to remove debris from the entry point.

In addition to fibrous materials, a similar problem exists for cleaning pets with hair. Pets that shed hair, such as cats and dogs, tend to shed hair in the house, which requires the homeowner to constantly clean pet hair that is shed. While hairbrushes are available to collect hair directly from the pet, this requires cleaning of the brush after use and cleaning dislodged hair from the pet's surroundings, which is messy and time consuming. The same problem exists for cleaning materials with fibers that are lengthy such as furry coats and furry rugs.

Therefore, there exists a need for a vacuum cleaner or a vacuum cleaner attachment that provides an efficient and convenient means of cleaning debris from fibrous materials, and for grooming and collecting pet hair.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention provides a simple and affordable cleaning device that can efficiently remove light debris from fibrous surfaces, and directly from pets with hair.

In one aspect, the present invention provides a cleaning device comprising: a base member extending longitudinally between a first distal end and a first proximal end, the first proximal end of the base member being at an angle relative to the first distal end of the base member; a support member extending longitudinally between a second distal end and a second proximal end, the second proximal end integrally formed with the first proximal end of the base member; at least one support flange coupling the base member and the support member; an extension member extending from the second distal end of the support member and integrally formed therewith; and at least one teeth member comprising a contact surface and an attachment surface, the attachment surface formed with an inner channel, the inner channel coupled with one of the first distal and proximal ends, the contact surface having outer flanges with an outer channel formed therein, the outer channel positioned opposite the inner channel; wherein the contact surface is adapted to come in contact with a cleaning surface such that the outer flanges penetrate the cleaning surface to dislodge and collect debris.

In another aspect, the present invention provides a cleaning device comprising: a base member extending longitudinally between a first distal end and a first proximal end; a support member extending longitudinally between a second distal end and a second proximal end; at least one support flange coupling the base member and the support member; an extension member extending from the second distal end of the support member; and at least one teeth member comprising a contact surface and an attachment surface, the attachment surface formed with an inner channel, the inner channel coupled with the base member proximate one of the first distal and proximal ends, the contact surface having outer flanges with an outer channel formed therein, the outer channel positioned opposite the inner channel; wherein the contact surface is adapted to come in contact with a cleaning surface such that the outer flanges penetrate the cleaning surface to dislodge and collect debris.

In yet another aspect, the present invention provides a cleaning device a base member extending longitudinally between a first distal end and a first proximal end; a support member extending longitudinally between a second distal end and a second proximal end; an extension member extending from the second distal end of the support member; and at least one teeth member comprising a contact surface and an attachment surface, the attachment surface formed with an inner channel, the inner channel coupled with the base member proximate one of the first distal and proximal ends, the contact surface having outer flanges with an outer channel formed therein, the outer channel positioned opposite the inner channel; wherein the contact surface is adapted to come in contact with a cleaning surface such that the outer flanges penetrate the cleaning surface to dislodge and collect debris.

Also, to solve the problems of the prior art, an object of the present invention is to provide an attachment or suction head for a vacuum cleaning machine that effectively removes fibrous debris such as hair and lint from different surfaces, and to provide an effective means of grooming pets and collecting pet hair with enhanced efficiency. Another object of the present invention is to provide an attachment for a vacuum cleaning machine that is cost effective, sturdy and reliable. Yet another object of the present invention is to provide a vacuum cleaning attachment which has an ergonomic design and ease of portability when it comes to replacements and retrofitting.

The present invention also relates to an attachment for a vacuum cleaning machine, which facilitates the users in efficiently cleaning fibrous debris from all kinds of surfaces in a convenient manner so as to not block a suction mouth or suction passage of the vacuum cleaner. In addition, the attachment facilitates removal of the fibrous debris in manner that it does not obstruct the usual working suction of the machine, thereby eliminating the extra manual effort required in cleaning the attachment after a cleaning exercise.

In one aspect, the present invention provides a cleaning device comprising: a body having an inlet and an opposing outlet, each of the inlet and outlet having peripheral edges, the body having a hollow interior between the inlet and the outlet, the outlet adapted to be connected to a vacuum cleaner and the inlet adapted to make contact with a cleaning surface, the inlet having a support member extending from the inlet peripheral edge; and an elongated member having a contact surface and an attachment surface, the attachment surface formed within a first channel, the first channel coupled with the support member, the contact surface adapted to come in contact with the cleaning surface; wherein the contact surface comprises a plurality of flanges extending radially along the length of the elongated member such that the flanges penetrate the cleaning surface to dislodge and collect debris.

In another aspect, the present invention provides a cleaning device comprising: a body having an inlet and an opposing outlet, each of the inlet and outlet having peripheral edges, the inlet having a support member extending from the inlet peripheral edge; and an elongated member having a contact surface and an attachment surface, the attachment surface formed within a first channel, the first channel coupled with the support member, the contact surface adapted to come in contact with a cleaning surface; wherein the contact surface comprises a plurality of flanges extending radially along the length of the elongated member such that the flanges penetrate the cleaning surface to dislodge and collect debris.

In yet another aspect, the present invention provides a cleaning device comprising: a body having an inlet and an opposing outlet; and an elongated member having a contact surface and an attachment surface, the attachment surface adapted to be attached to the body proximate the inlet, the contact surface adapted to come in contact with a cleaning surface; wherein the contact surface comprises a plurality of flanges extending radially along the length of the elongated member such that the flanges penetrate the cleaning surface to dislodge and collect debris.

Various objects, features, aspects and advantages of the inventive subject matter will become more apparent from the following detailed description of preferred embodiments, along with the accompanying drawing figures in which like numerals represent like components.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one ordinarily skilled in the art to variously employ the present invention in virtually any appropriately detailed structure. It is to be understood that other embodiments may be utilized, and structural changes may be made without departing from the scope of the invention.

All referenced methods are incorporated herein by reference in their entireties. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, the inventor in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

Teeth Members

Figure 1:
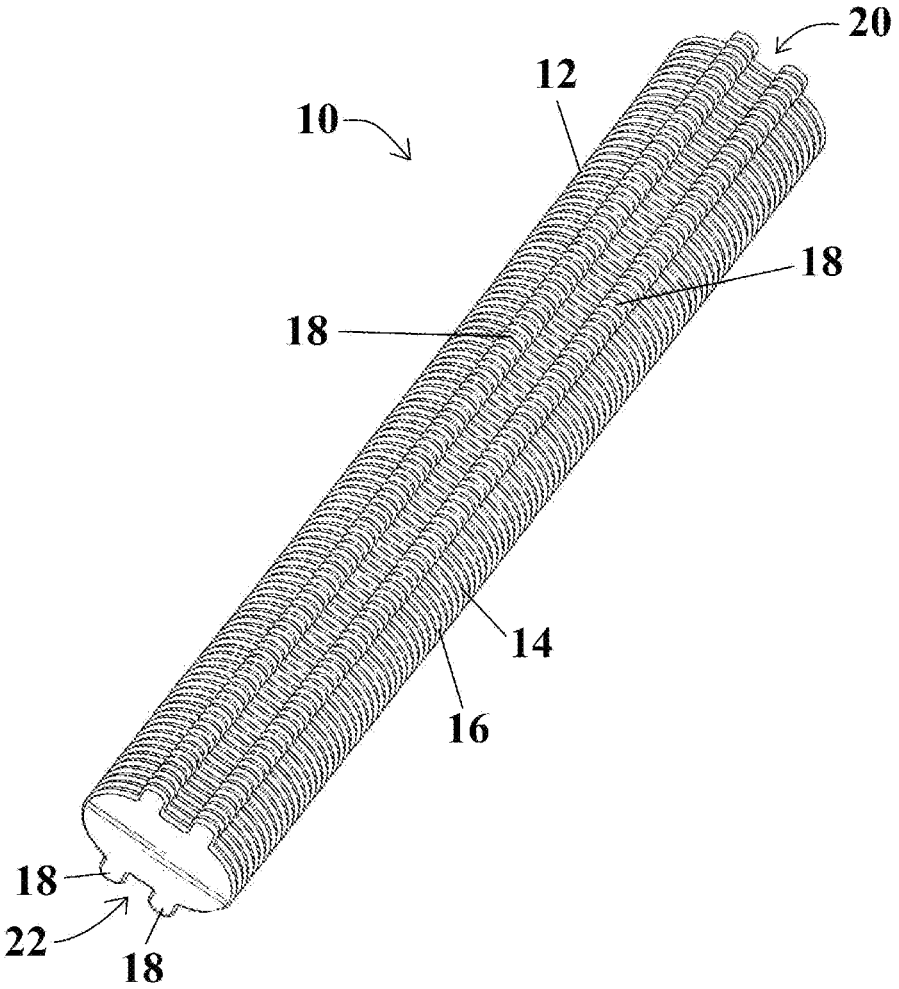
FIG. 1 illustrates a perspective view of an embodiment of an attachment or teeth member of a cleaning device of the present invention.

FIG. 1 illustrates a perspective view of an attachment or teeth member having an elongated member 10 for a cleaning device, such as suction head of a vacuum cleaning machine or a head member of the cleaning device, in accordance to an embodiment of the present invention. The attachment or teeth member is an elongated member 10 having teeth and adapted to be secured to a suction head of a vacuum cleaning machine or a head member of a cleaning device. In an embodiment, the elongated member 10 has opposing surfaces that allow the member 10 to be attached to the suction head or a head member of a cleaning device from one side of the member 10 and clean fibrous debris from the other side of the member 10, as will be described in detail below. These surfaces have also been respectively referred to as attachment surface (received by the suction head or head member of a cleaning device) and contact surface (comes in contact with a surface to be cleaned) when referring to the attachment as a component of the suction head of the vacuum machine or a head member of the cleaning device in working condition to clean a surface.

In this embodiment, the elongated member 10 has a substantially circular cross-section area. However, the elongated member 10 may be of a different cross section as well, such as square, rectangular and oval cross-sections. The elongated member 10 is made of a sturdy material such as metal, rigid plastic, polymer or a reinforced material. The choice of material used for the elongated member 10 is dependent on considerations such as weight and durability. In this embodiment, the elongated member 10 is constructed of aluminum.

In this embodiment, the elongated member 10 is machined such that radially outer portions 12 of the elongated member 10 are provided with a plurality of grooves 14 continuously extending or circumscribing the member 10, thus forming a plurality of flanges 16 there between. The flanges 16 also continuously extend or circumscribe the elongated member 10. In this embodiment, the flanges 16 have substantially flat outer surfaces and are spaced apart equally. As such, potential contact with any sharp edges is avoided to provide safety to the user. Moreover, based on testing, it has been found that minimal spacing between the flanges 16 yields optimal results for collecting small fibrous debris such as hair and lint. However, the spacing of the grooves 14 and the flanges 16 could vary without departing from the spirit and scope of the invention.

Still referring to FIG. 1, the flanges 16 on top and bottom sides of the member 10 include portions that extend radially outwardly from the remaining portions of the flanges 16. Specifically, a pair of spaced apart flange extensions or protrusions 18 is provided on each side, forming opposing channels 20, 22 there between. The pair of protrusions 18 on each opposing side of the elongated member forms the surfaces required for attachment with the suction head or head member of a cleaning device on one side of the member 10, i.e., an attachment surface, and contacting a surface to be cleaned from the other side of the member 10, i.e., a contact surface. In particular, as shown in the figure, a top channel 20 is shaped and sized to receive the suction head or head member of a cleaning device while the bottom channel 22 comes in contact at an angle with the surface to be cleaned. It shall be noted that depending on the size and shape of an engagement portion of the suction head or head member of the cleaning device, the op channel 20 could take on other sizes and shapes. Also, in this embodiment, the top and bottom channels 20, 22 are positioned directly opposite each other. However, the top and bottom channels 20, 22 could be positioned differently depending on the configuration of the suction head or head member of the cleaning device and an angle of attack.

Figure 25:
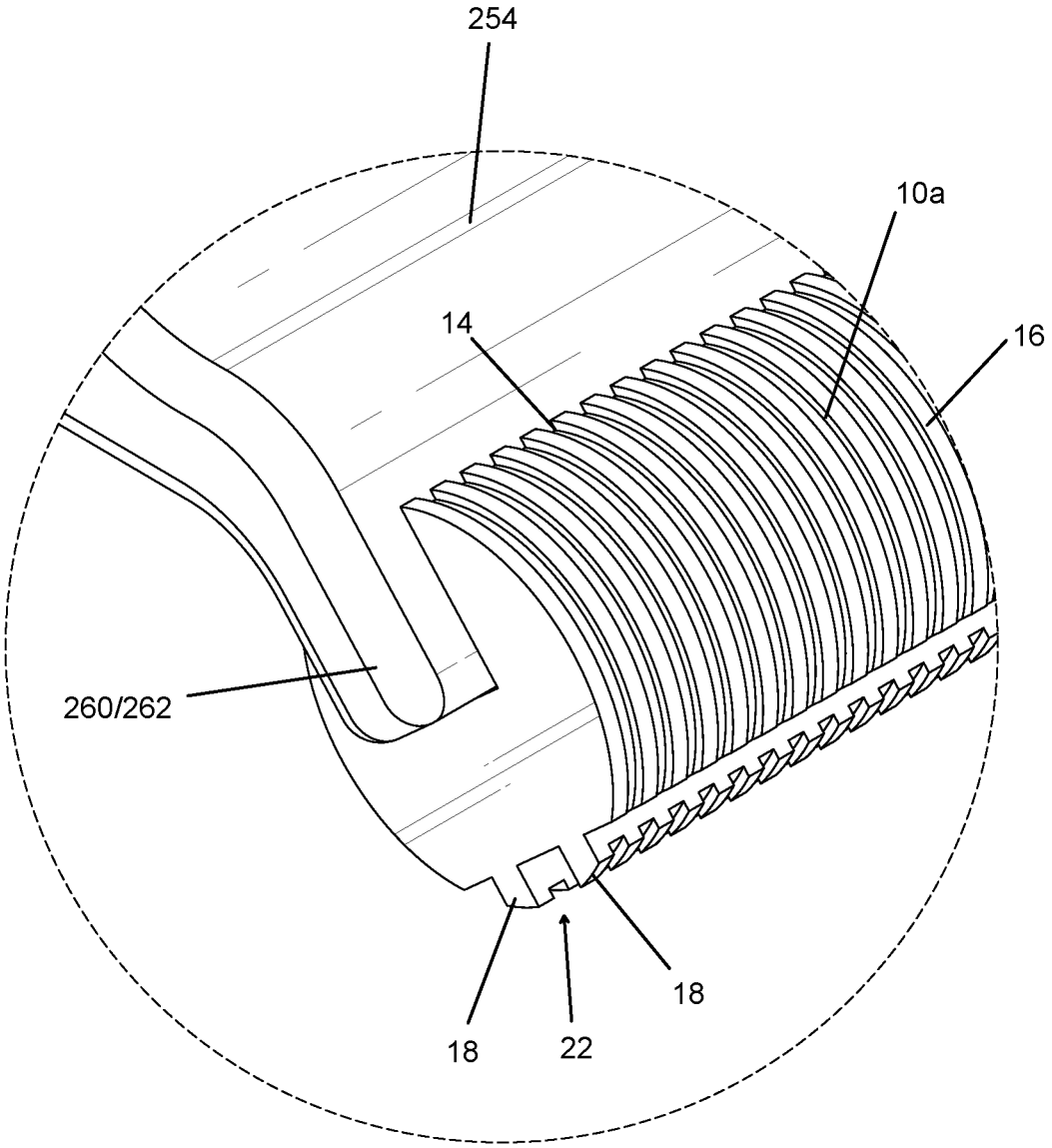
FIG. 25 is an enlarged view of the portion designated "25" in FIG. 18.
Figure 26:
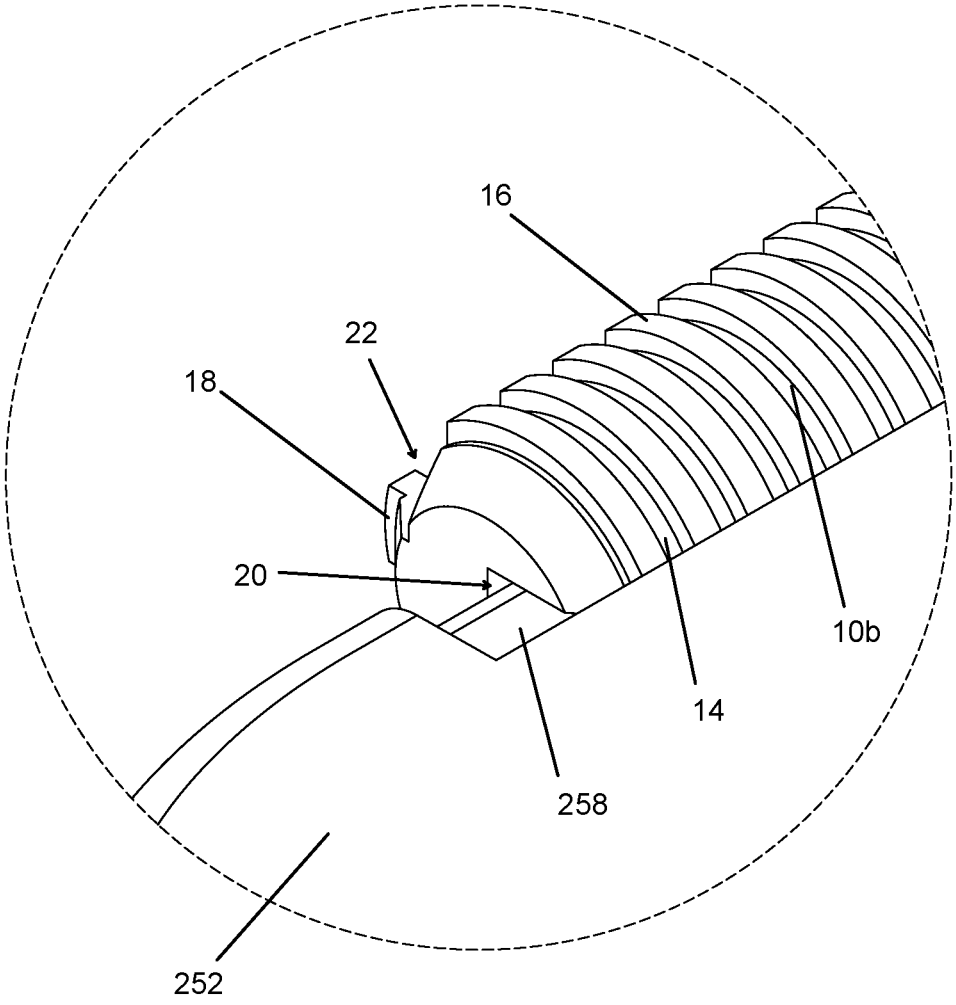
FIG. 26 is an enlarged view of the portion designated "26" in FIG. 18.

In this embodiment, each protrusion 18 is substantially half-circle in shape to minimize unwanted friction between the flange extensions 18 and a cleaning surface when in use. That is, the half-circle shape provides minimum but sufficient contact area to ensure that the member 10 is able to smoothly move along the cleaning surface while cleaning effectively. The shape of the protrusions 18 as shown in FIG. 1 also minimizes the risk of damaging the cleaning surface. However, the flange extensions or protrusions 18 could take on other shapes, such as triangle or square, for example, as shown in FIGS. 25 and 26, Moreover, generally as only the protrusions 18 will make contact with the cleaning surface, other portions of the flanges 16 could be machined to be solid rather than have flanges 16. In any event, it is preferable that the bottom channel 22 be parallel to the cleaning surface when in use to maximize efficiency of the cleaning device. That is, cleaning is most effective when the protrusions 18 engage the cleaning surface at a right angle. Depending on the application, for example, a thin rug compared with a thick carpet, the length of the protrusions 18 could vary, as shown in FIGS. 25 and 26.

In this embodiment, the overall cross-sectional dimensions of the elongated member 10 are 8 mm×8 mm; the flanges 16 are spaced apart by 0.52 mm; the flange extensions 18 are spaced apart 1.33 mm and each flange extension 18 is 1.09 mm wide. However, the dimensions could vary depending on the application.

Figure 2:
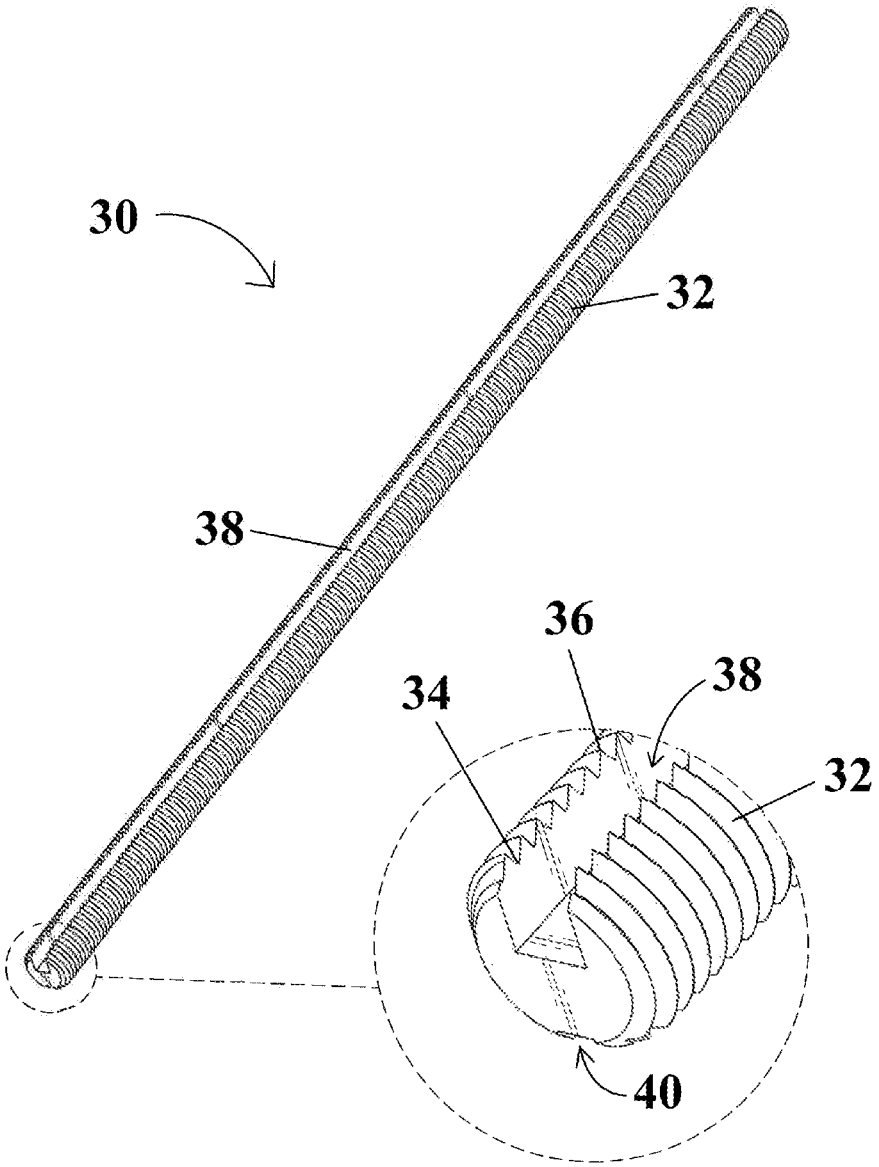
FIGS. 2 and 3 illustrate top and bottom perspective views of another embodiment of an attachment or teeth member of a cleaning device of the present invention.
Figure 3:
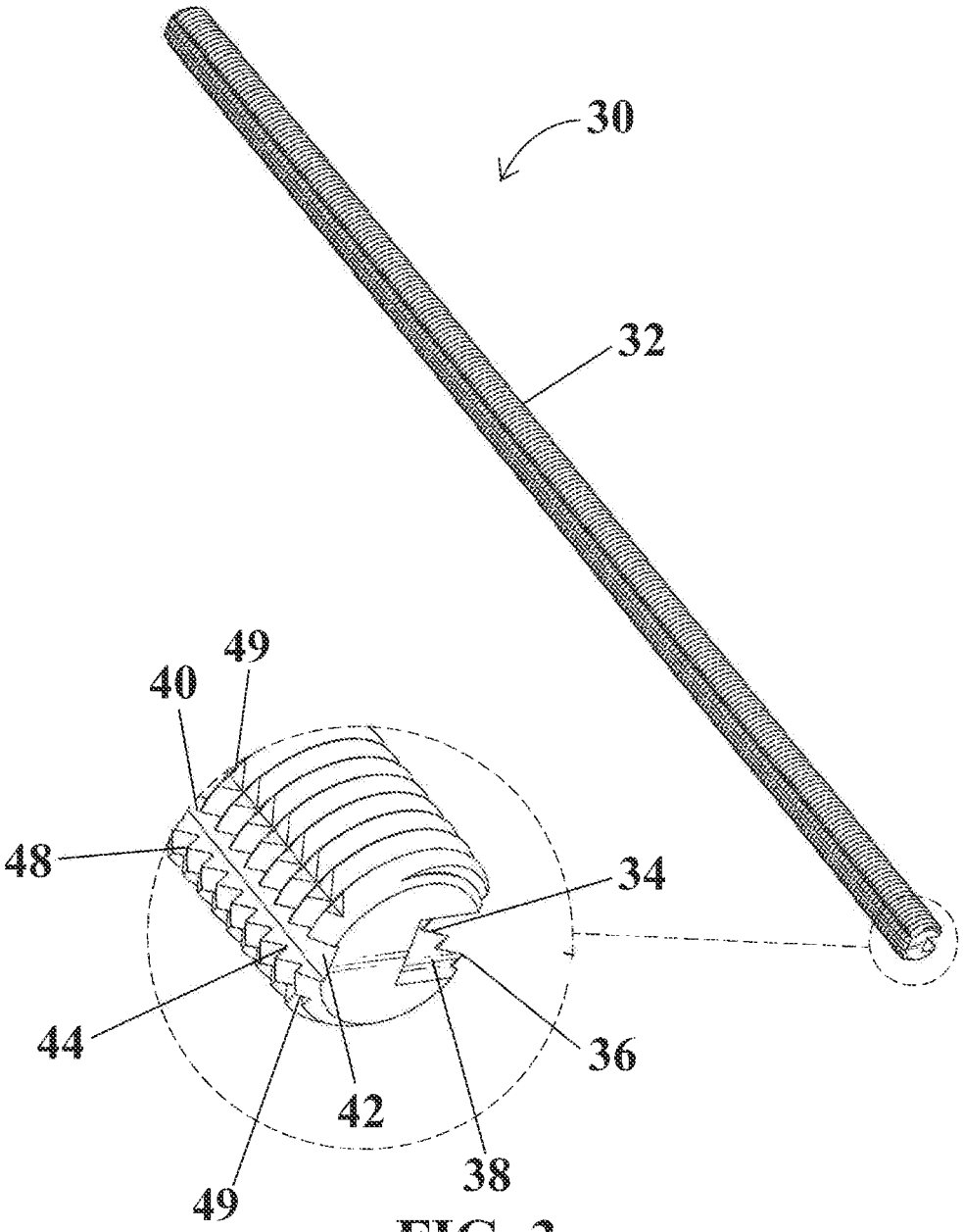

Referring now to FIGS. 2 and 3, a second embodiment of an attachment or teeth member 30 of the present invention is shown. Similar to the first embodiment described above, the teeth member 30 is constructed of a solid material, such as metal, and having a substantially circular cross-section. In this embodiment as well, the teeth member 30, interchangeably referred hereinafter as elongated member, is made of aluminum as it is durable and light weight. However, other materials could be used, such as steel and plastic. Also, the cross-section of the elongated member 30 could take on other sizes and shapes, for example, square, rectangular or oval, without departing from the spirit and scope of the invention. The elongated member 30 is machined such that radially outer portions 32 of the elongated member 30 are provided with a plurality of grooves 34, thus forming a plurality of flanges 36 therebetween. In this embodiment, the flanges 36 are substantially triangular in cross-section and have substantially pointy outer edges and are spaced apart equally.

Based on testing, it has been found that minimal spacing between the flanges 36 yields optimal results for collecting small fibrous debris such as hair and lint. However, the spacing of the grooves 34 and flanges 36 could vary without departing from the spirit and scope of the invention. As shown in FIG. 3, the height of the flanges 36 in this embodiment is less than that of the flanges 16 in the first embodiment 10. This is to ensure that the cleaning surface is not damaged when the cleaning device is in use.

Still referring to FIGS. 2 and 3, in this embodiment, the grooves 34 and flanges 36 discontinue on top and bottom sides of the teeth member 30. As shown in FIG. 2, the top side includes a substantially flat top channel 38 having a floor or attachment surface, and the bottom side directly opposite the top side includes a substantially flat bottom channel 40 having a floor or contact surface. As will be described in more detail below, the top channel 38 is shaped and sized to receive a suction head or a body of any other cleaning device. Thus, depending on size and shape of an engagement portion of the suction head or the body of any other cleaning device, the top channel 38 could take on other sizes and shapes. Also, in this embodiment, the top and bottom channels 38, 40 are positioned directly opposite each other; however, the top and bottom channels 38, 40 could be positioned differently depending on the configuration of the head member.

In this embodiment, the bottom channel 40 is sized such that a bottom surface 42 thereof is positioned below the lowermost portion 44 of the grooves 34. Also, a width of the bottom channel 40 is minimal to ensure user safety. As such, the outer edges of the flanges 36 extending from the bottom channel 40 form flange extensions or protrusions 48 that engage the cleaning surface at a preferred angle. It is preferable that the bottom channel 40 be perpendicular to the cleaning surface when in use to maximize efficiency of the cleaning device. That is, cleaning is most effective when the protrusions 48 engage the cleaning surface at a right angle. Depending on the application, for example, a thin rug compared with a thick carpet, the length of the flange extensions 48 could vary.

Referring to FIG. 3, a valley 49 is formed adjacent each of the flange extensions 48 and extend along the teeth member 30. In this embodiment, each valley 49 is substantially narrow and triangular in shape. The valleys 49 also aid in loosening debris and collecting fibrous debris from the material being cleaned. As will be described below, the dimensions and sizes of each valley could vary depending on the application.

In this embodiment, the teeth member 30 has a cross-sectional radius of 3.57 mm; the top channel is 3 mm wide; the bottom channel is 1.8 mm wide; the valley is 1.09 mm×0.8 mm; the flanges 36 are spaced apart by 1.02 mm; the flanges have a height of 0.75 mm; and each flange 36 have a pitch angle of 0.87.

Figure 4:
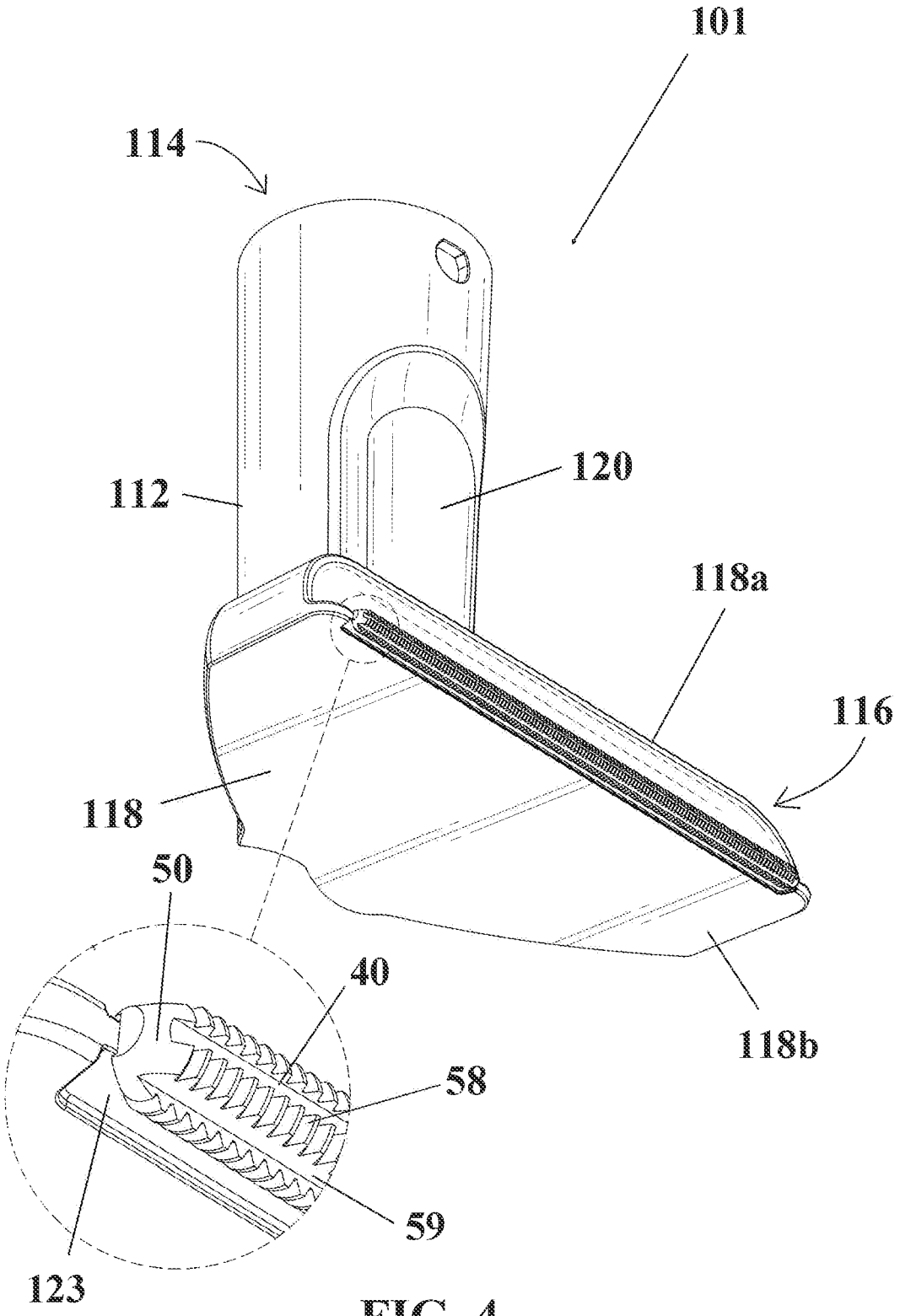
FIG. 4 illustrates an embodiment of a cleaning device of the present invention with another embodiment of an attachment or teeth member.

Referring to FIG. 4, in another embodiment, the teeth member or elongated member 50 is substantially similar to the teeth member or elongated member 30 described above with a few exceptions. First, the ends of the elongated member 50 are beveled so that any sharp edges are eliminated. Second, the width of the valleys 49 are broader than the valleys 49 of the elongated member 30. The elongated member 50 includes a top channel 40 having a contact surface and an opposing channel having an attachment surface. A plurality of radial protrusions or flanges 58 extend from the contact surface, i.e., the surface that contacts the cleaning surface. The radial protrusions 58 are developed in a linear orientation along a length of elongated member 50 and have triangular slots or valleys 59 running through the length of the member 50.

The elongated members 10, 30, 50 are secured to a support member 122 of a suction head or head member of a cleaning device as shown, for example, in FIGS. 4, 11, 13 and 18. Specifically, the support member 122, which extends from a peripheral edge of an inlet of the suction head, is secured to the channels 20, 38 of the elongated members 10, 30, 50 by snap-fit. In addition or in the alternative, the channels 20, 38 could be secured to the support member 12'2 via adhesive. Similarly, the distal end 258 (FIG. 18), proximal ends 260, 262 (FIGS. 11, 13 and 18) or the engagement member 190 (FIG. 16), which extends from a peripheral edge of the head member 150, 180, are secured to the channels 20, 38 of the elongated members 10, 30, 50 by snap-fit. In addition or in the alternative, the channels 20, 38 could be secured via adhesive.

Suction Heads/Vacuum Attachments

In another aspect, the present invention relates to an attachment or suction head for a vacuum cleaning machine for collecting debris, including fibrous debris, from a fibrous material, without employing any special means. Further, the disclosed invention aids in complete removal of debris in a time effective and efficient manner.

Figure 5:
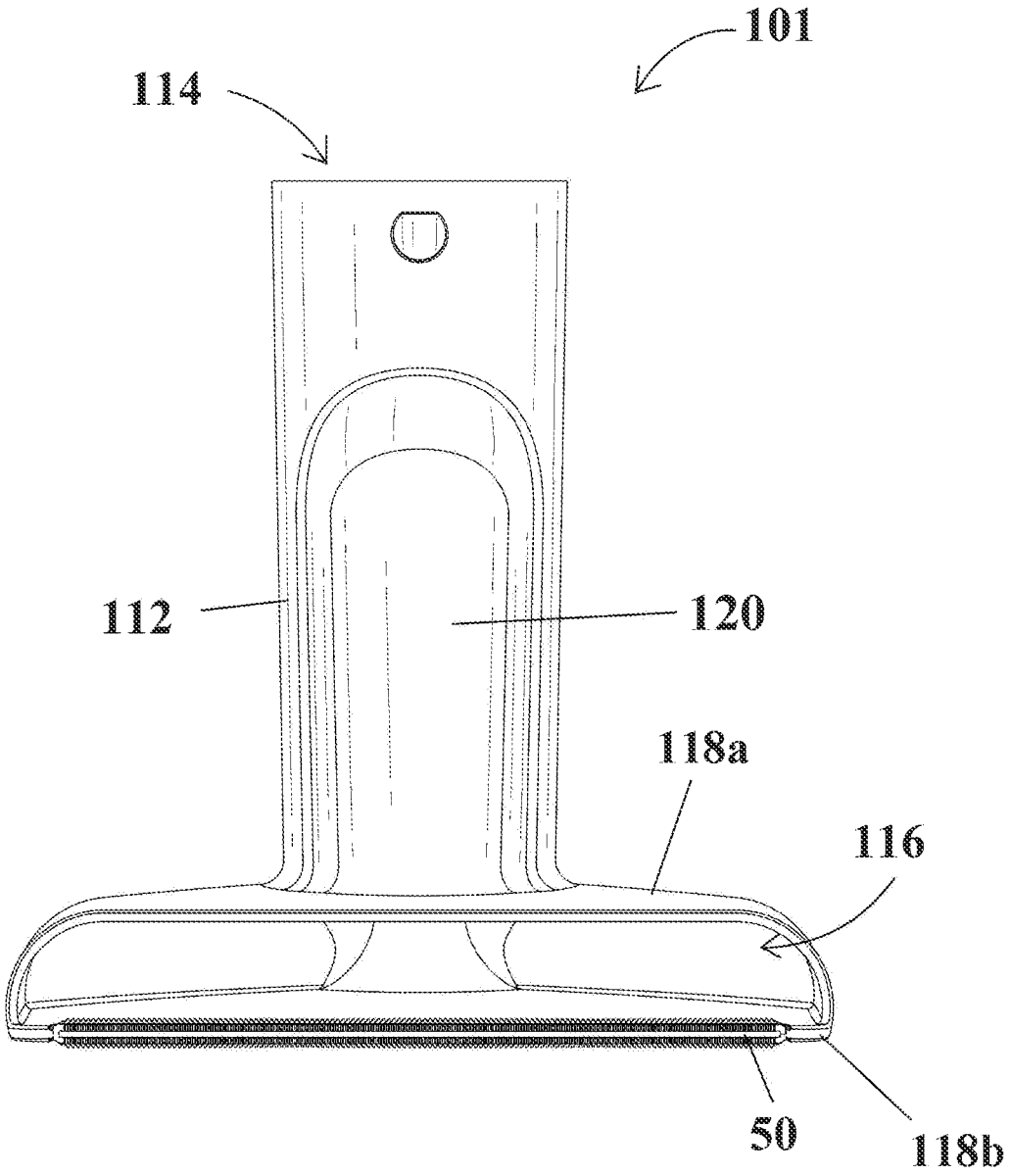
FIGS. 5 and 6 illustrate front and rear views, respectively, of the cleaning device of FIG. 4.
Figure 6:
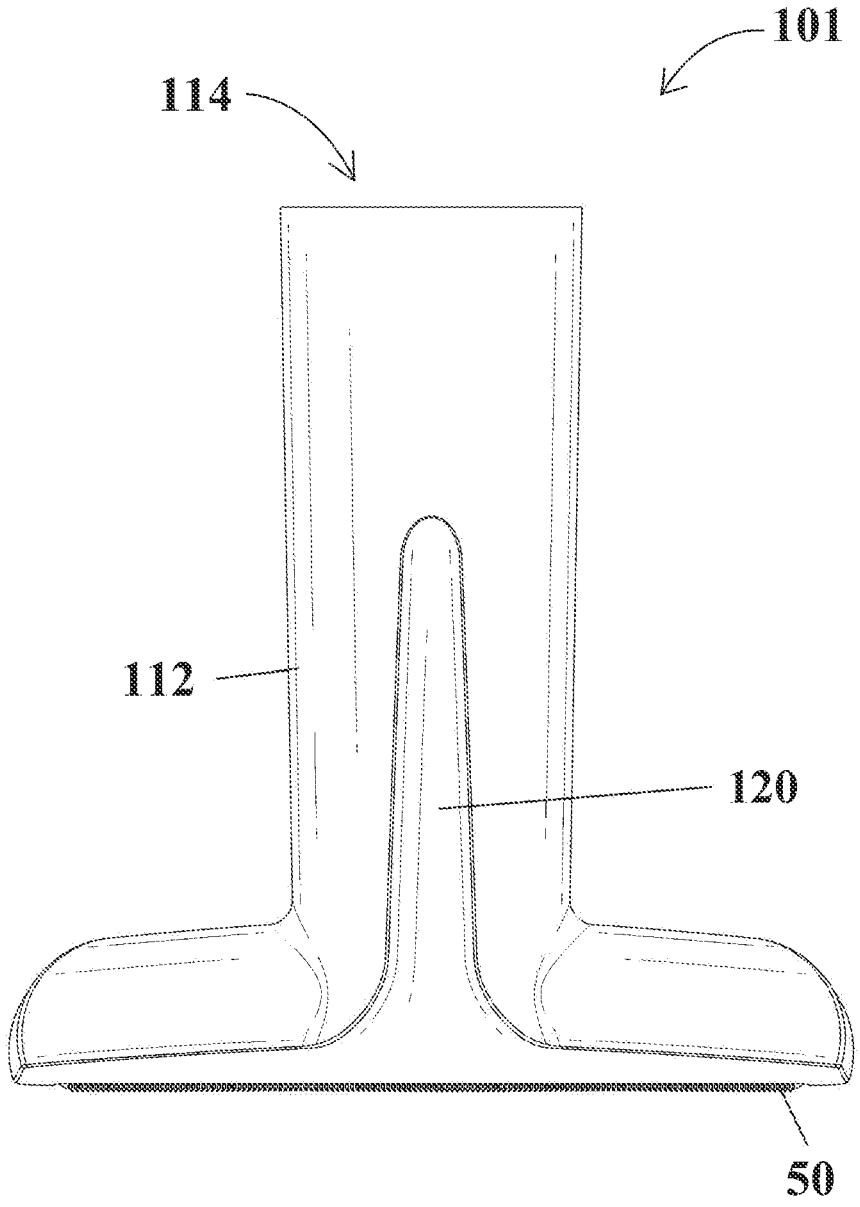

FIGS. 4-6 show an embodiment of a cleaning device for use as a suction head 101 of a vacuum cleaning machine, in accordance with the present invention, with a teeth member or elongated member 50 as the attachment. The suction head 101 in this embodiment includes a body 112 having a hollow pipe 120 and a head component 118, having a top wall 118*a* and an opposing bottom wall 118*b*, integrally formed together. The head component 118 is attached to the pipe 120 substantially at a right angle for maximum efficiency. The body 112 includes an outlet 114 at an open end of the hollow pipe 120 and an inlet 116 at a mouth of the head component 118. The outlet 114 is configured to be attached with an inlet of a hose or an extension nozzle of the vacuum cleaning machine. The mouth of the head component 118 is structured wide enough to receive the elongated member 50 lengthwise. The pipe 120 is formed integrally with the head component 118.

The suction head 101 further includes a receiving section, which includes a support member 122 adapted to receive a corresponding attachment surface of the elongated member 50, i.e., channel 38 shown in FIGS. 2 and 3, for affixing the elongated member 50 at the mouth of the head component 118 of the suction head 101 at the bottom wall 118*b*. In this embodiment, the support member 122 (as shown in FIG. 4) extends from a lower edge of the bottom wall 118*b* of the head component 118. As shown in FIG. 4, a bottom surface of the bottom wall 118*b* of the head component 118 includes a cutout 123 extending the length of the bottom wall 118*b* to accommodate for a bottom portion of the length of teeth member 50. As such, the elongated member 50 has maximum exposure to the surface being cleaned.

The support member 122 is shaped and sized to receive an attachment surface, i.e., channel, of the elongated member 50. However, the support member 122 may be shaped differently to receive elongated members of different configurations as described in the present disclosure. For example, in an alternative embodiment, the support member 122 could be U-shaped to receive a corresponding U-shaped channel of the elongated member. In a further alternative, another support member could extend along a length of the edge of the head component top wall 118*a* and have an elongated member attached thereto. As a result, multiple elongated members could scrape the cleaning surface to further increase cleaning efficiency.

The suction head 101 may be constructed using materials including plastic as a one-piece structure via injection molding techniques. Alternatively, other materials such as metal and composite materials may also be used.

In operation, the user holds the suction head 101 at the pipe 120 and engages the inlet 116 on the cleaning surface. The user pulls the suction head 101 toward the user such that the flanges 58 of the elongated member 50 scrape the cleaning surface and material therein. During that motion, debris is dislodged from the material being cleaned and travels through the inlet 116 and into the vacuum machine. The user may also push the suction head 101 during use but may not achieve best results.

Figure 7:
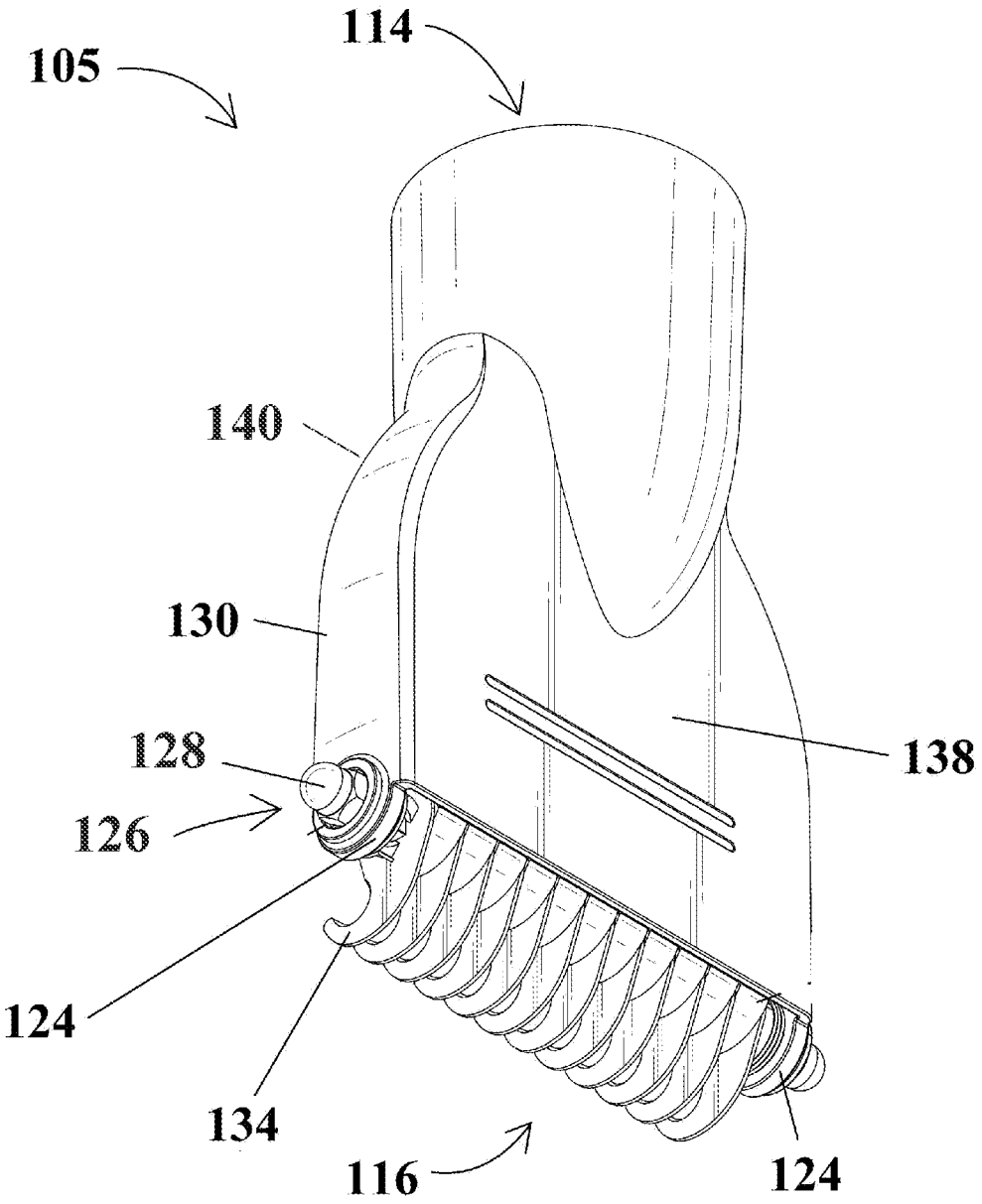
FIG. 7 illustrates a perspective view of another embodiment of a cleaning device of the present invention with another embodiment of an attachment or teeth member.
Figure 8:
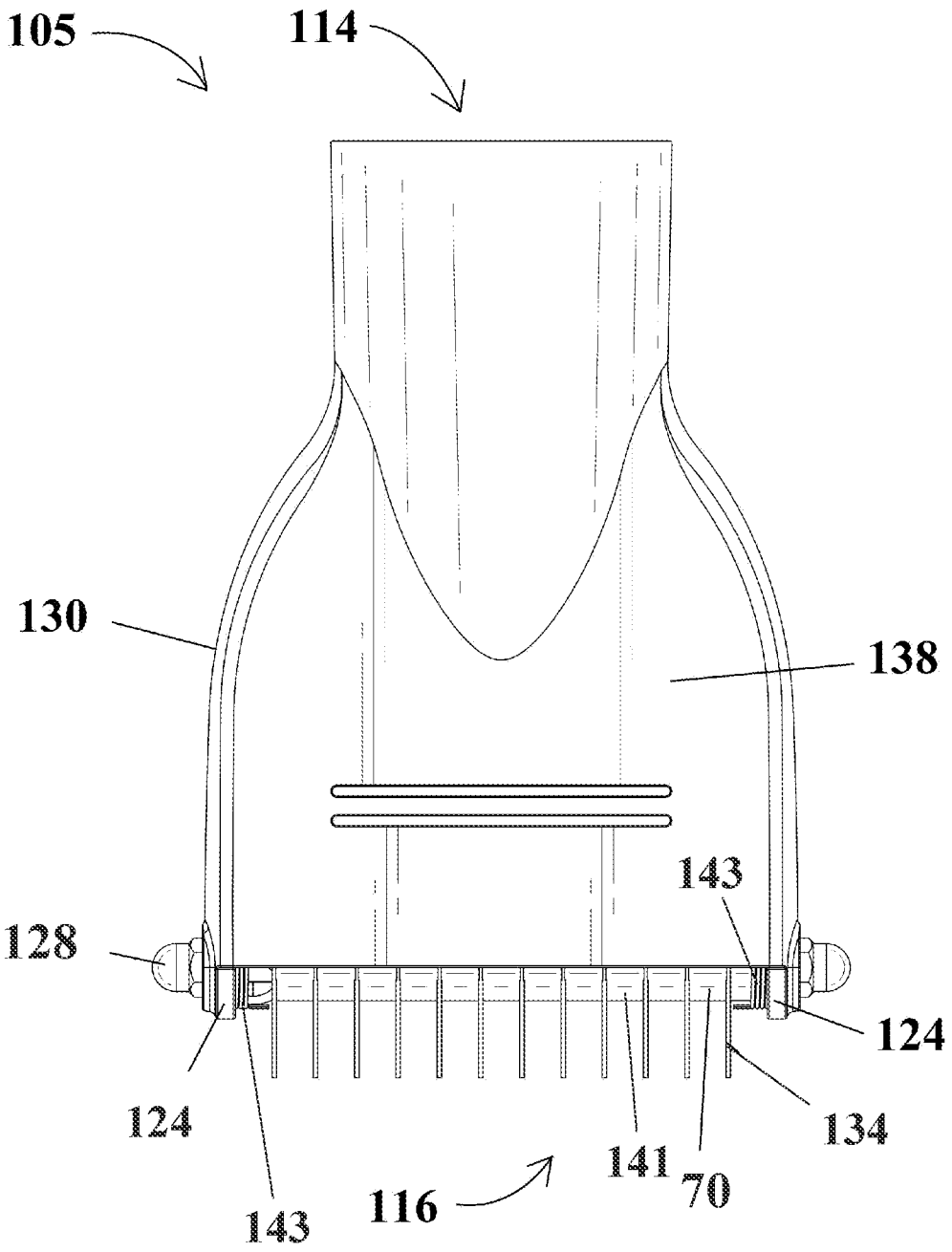
FIGS. 8 and 9 illustrate front and rear views, respectively, of the cleaning device of FIG. 7.
Figure 9:
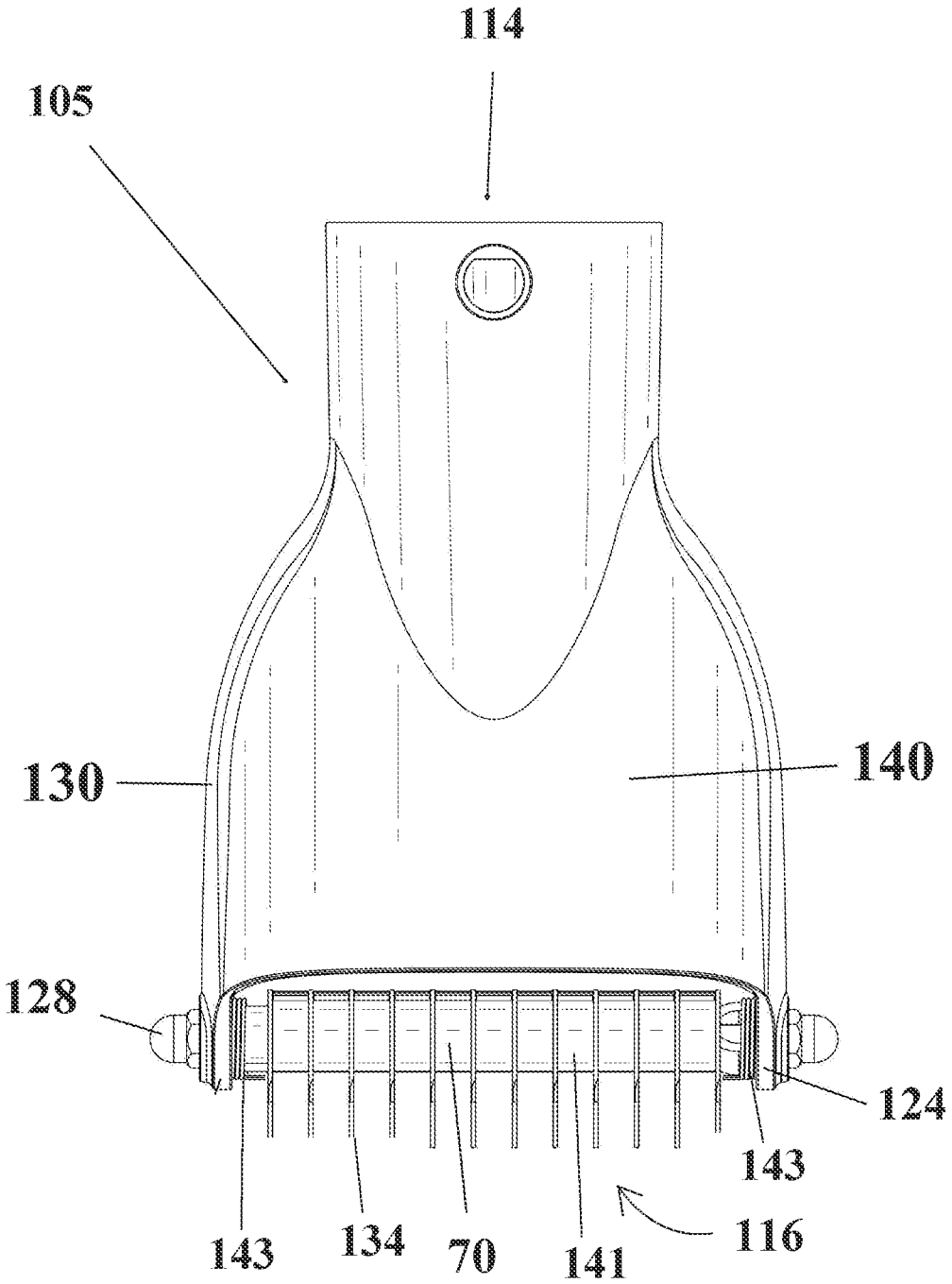

In reference to FIGS. 7-9, a perspective view of another embodiment of a cleaning device, for use as a suction head 105 for a vacuum cleaning machine is shown, in accordance with another embodiment of the invention. The suction head 105 is adapted to receive another embodiment of an elongated member or teeth member 70. The suction head 105 includes a hollow body 130 having an outlet 114 and an inlet 116, like the previous suction head embodiment 101. However, the body 130 is linear in shape as opposed to having an angle between the hollow pipe 120 and head component 118 of the suction head embodiment 101 shown in FIGS. 4-6. The outlet 114 is adapted to be attached with an inlet of a hose or extension nozzle of a vacuum cleaning machine while the inlet 116 is structured with a mouth wide enough to receive the elongated member 70 lengthwise.

The body 130 is constructed with a front wall 138 and a rear wall 140 of similar structural dimensions except that the front wall 138 extends lower than the rear wall 140, as shown in FIGS. 8 and 9. This is to accommodate for fibrous debris accumulated between the elongated member 70 and the rear wall 140 during cleaning. Specifically, in use, the user will pull the suction head 105 across a cleaning surface or material with the front wall 138 facing up. Therefore, fibrous debris will accumulate between the elongated member 70 and the rear wall 140. Further, the body 130 includes a support member in the form of side flanges 124 extending from opposing lateral walls of the mouth at the inlet 116. The side flanges 124 have apertures 126 for receiving a fastener 128 therethrough to assemble the elongated member 70 on the mouth of the suction head. In this embodiment, the fastener 128 is a screw with treaded ends and threaded bolts attached thereto.

Referring to FIGS. 8 and 9, the elongated member 70 includes a shaft 141 extending between the side flanges 124 and having a through-hole along its length for receiving the fastener 128. The shaft 141 is secured in a substantially fixed position with biasing members 143 positioned at each end of the shaft 141 against the side flanges 124. In this manner, the rotation of the shaft 141 is limited, but some leeway is given to avoid snagging while the suction head 105 is in use.

Further in FIGS. 7-9, a plurality of radial protrusions or flanges 134 extend from the shaft 141 along a length of the shaft 141. Each of the protrusions or flanges 134 resemble claw-like structures for removal and extraction of any fibrous debris such as lint and shed hair from a fibrous surface. In this embodiment, the claw-like structures are spaced apart equally along the length of elongated member 70. In operation, the tips of the plurality of radial protrusions 134 of the suction head 105 forms a substantially right angle with the surface or material to be cleaned, thus, forming an appropriate angle of attack that results in an efficient displacement of fibrous debris upon pulling into the vacuum cleaning machine.

The suction head 105 of this embodiment is ideal for cleaning pet hairs or for collecting loose pet hair directly from a pet using vacuum action of the vacuum cleaning machine. Moreover, the suction head or cleaning device 105 is configured to detangle pet hair. This further avoids falling of hair in the surroundings due to suction force of the vacuum cleaning machine. The suction head 105 is also well-suited for cleaning furry materials, such as furry rugs and coats that have longer fibers. The suction head 105 may be constructed using materials including plastic as a one-piece structure via injection molding techniques. Alternatively, other materials such as metal and composite materials may also be used.

The cleaning devices 101, 105 shown in the figures and described above could be used manually as well. For example, an extension such as a handle or a broom stick could be attached to the outlet 114 such that a user could use the cleaning devices 101, 105 manually without suction from a vacuum cleaner. In this case, the debris collected from use would be manually removed from the inlet area 116 by the user.

Head Members

Figure 10:
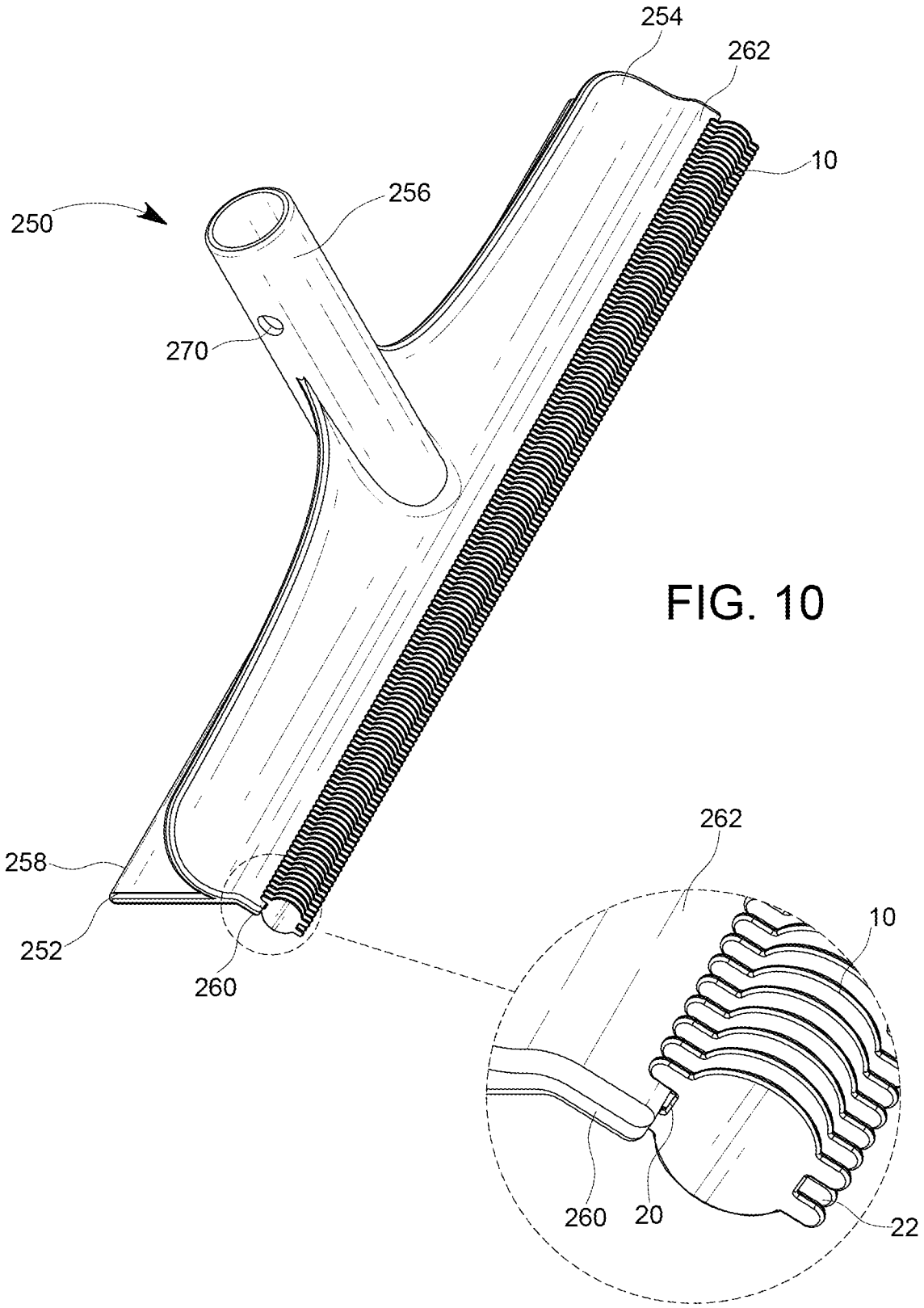
FIG. 10 is a perspective view of a first embodiment of a head member of the present invention having the teeth member of the first embodiment shown in FIG. 1.
Figure 11:
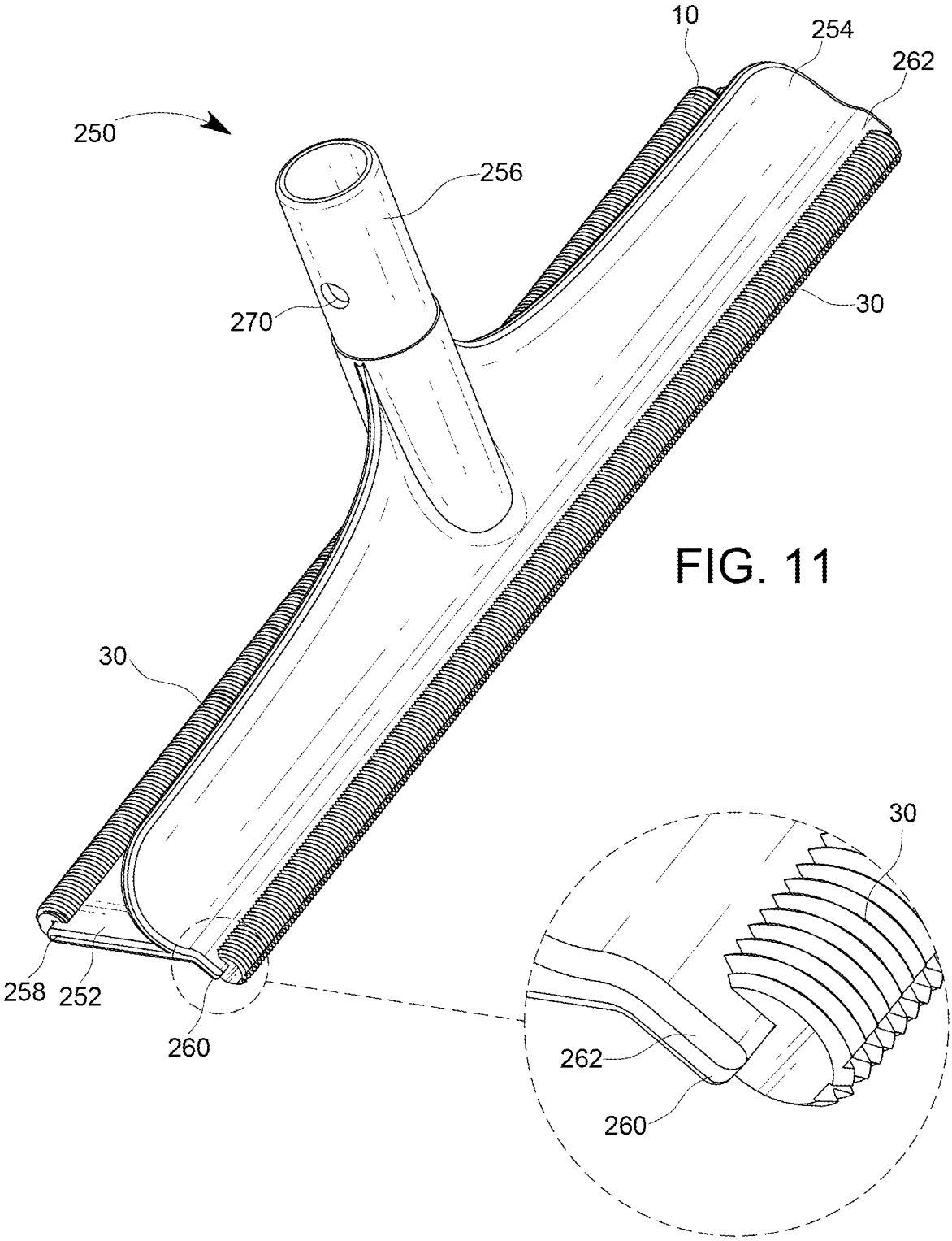
FIG. 11 is a perspective view of the head member of FIG. 10 having teeth members of the second embodiment shown in FIGS. 2 and 3.
Figure 12:
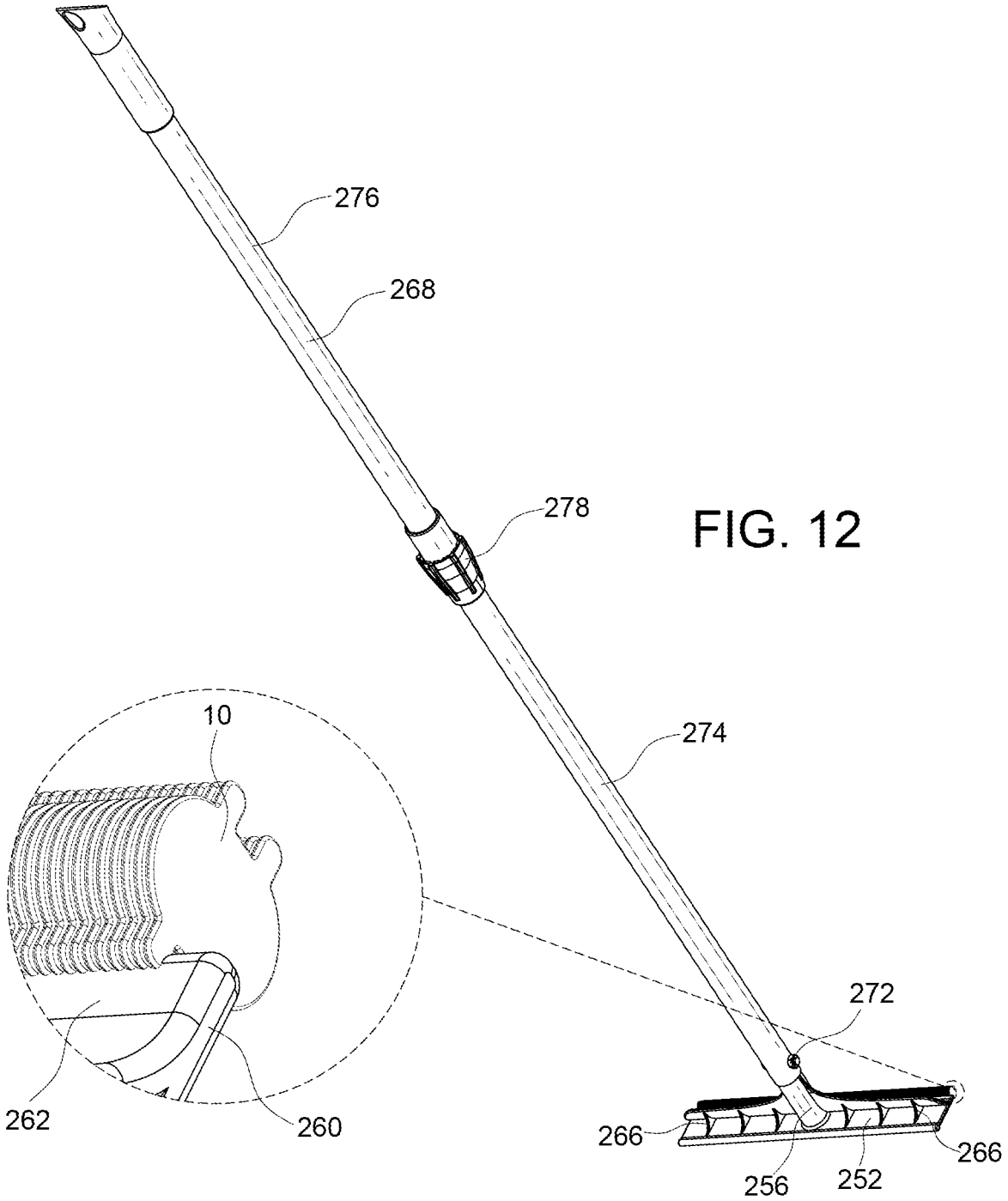
FIG. 12 is a perspective view of the head member of FIG. 10 attached to a handle member.
Figure 13:
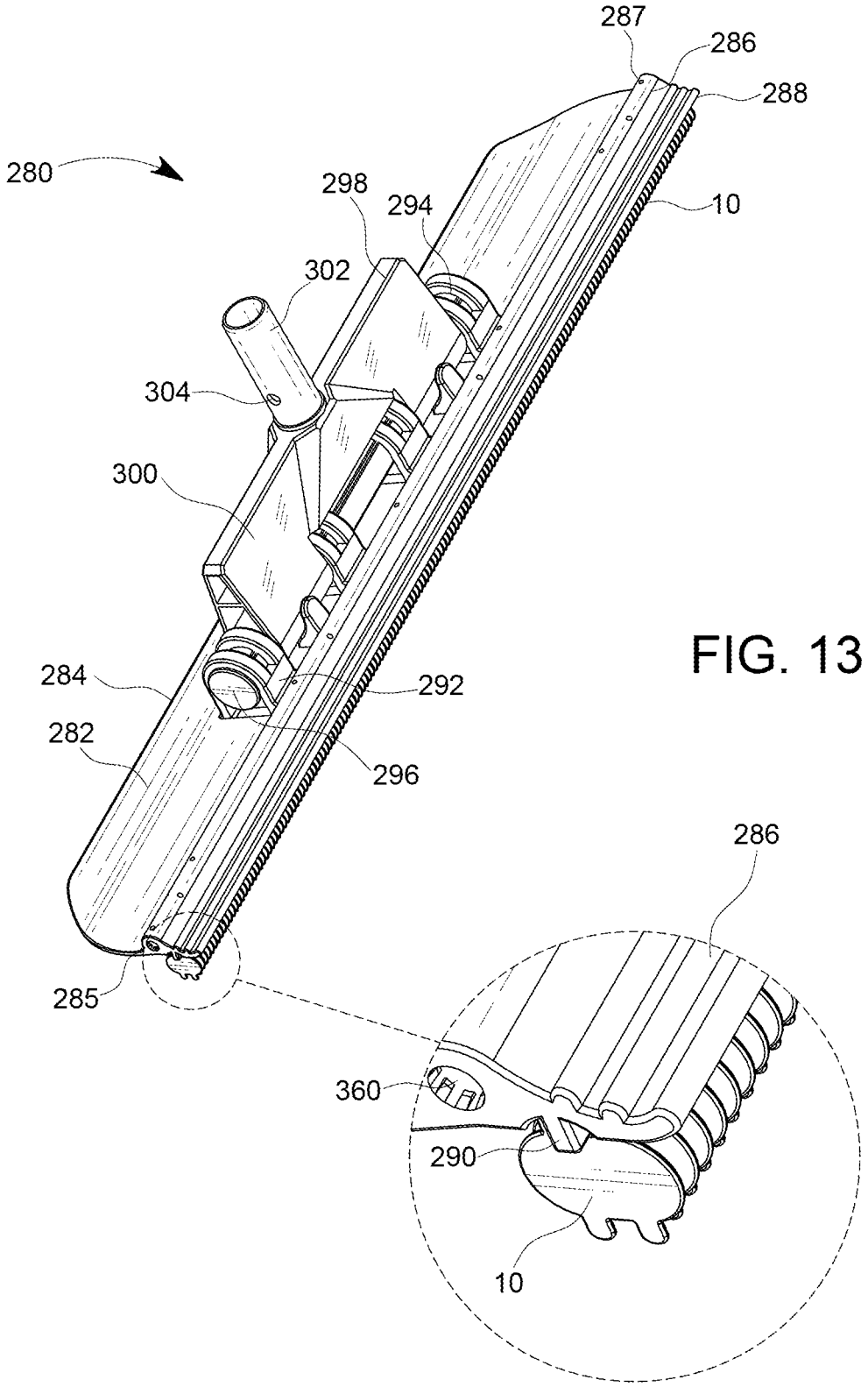
FIG. 13 is a perspective view of a second embodiment of a head member of the present invention having the teeth member of the first embodiment shown in FIG. 1.

Referring to FIGS. 10-12, a first embodiment of a head member 250 of the present invention is shown. In general, the head member 250 includes a base member 252 at a lower portion thereof, with a support member 254 integrally formed with the base member 252 and extending upwardly therefrom. An extension member 256 extends upwardly from an upper portion of the support member 254 and is integrally formed therewith.

The base member 252 is substantially flat and extends laterally approximately the length of the teeth member 10, 30. The base member 252 includes a transverse distal end 258 that is free and an opposing transverse proximal end 260 that extends downwardly at an angle.

The support member 254 also extends laterally approximately the length of the teeth member 10, 30 above the base member 252 at an acute angle. The support member 254 includes a transverse proximal end 262 which overlaps with and is integrally formed with the angled base member transverse proximal end 260. The support member 254 could be constructed with the base member 252 at any angle depending on the angle of the overlapping proximal ends 260, 262. The support member 254 is further supported to the base member 252 with support flanges 266 integrally formed therebetween, as shown in FIG. 12. The support member 254 further includes a transverse distal end 264 which is integrally formed with the extension member 256 to further strengthen the head member 250. In this embodiment, the angle of the overlapping proximal ends 260, 262 is between 48 and 78 degrees with respect to the flat portion of the base member 252, while the extension member 256 is constructed at a right angle with respect to the flat portion of the base member 252. This allows the user sufficient leeway to manually adjust the cleaning device so that the flange extensions or lips 18, 48 of respective teeth members 10, 30 are perpendicular or nearly perpendicular to the cleaning surface without discomfort when in use. Such adjustment could be necessary depending on the height of the user when using an extendable handle member as described below.

Still referring to FIGS. 10-12, the head member 250 is configured to receive two teeth members. In one embodiment, as shown in FIGS. 10 and 12, the teeth member 10 is attached to the overlapping proximal ends 260, 262 by snap-fit or friction-fit. Specifically, the size and shape of the overlapping proximal ends 260, 262 is substantially the same as the top channel 20 such that a substantially permanent engagement is formed. Similarly, as shown in FIG. 11, the teeth member 30 of the second embodiment could be snap-fit or friction-fit by attaching the top channel 238 to the overlapping proximal ends 260, 262. In another embodiment, as shown in FIG. 11, the teeth member 30 could attach to the base member distal end 258. Here, the distal end 258 is sized and shaped substantially the same as the top channel 38 to form a substantially permanent snap-fit or friction-fit. Similarly, the teeth member 10 of the first embodiment could be attached to the base member distal end 258. Alternatively, the teeth member 10, 30 could be attached to the head member 250 ends 258, 260, 262 by other methods such as adhesives, fasteners and welding.

As shown in FIGS. 10-12, preferably, the head member 250 is configured such that the head member distal end 258 is positioned closer to the user, and the head member proximal end 260 includes a teeth member 10, 30 and is positioned away from the user. In use, the teeth member 10, 30 is engaged with the cleaning surface and the user pulls the head member 250 toward the user.

Referring to FIGS. 18-26, an alternative embodiment of the head member 250 is shown. The overall structure of the head member 250 is substantially similar to that shown in FIG. 11 and therefore, each common component of the head member 250 is numbered in FIGS. 18-26 and the description above is incorporated by reference. In this embodiment, however, the head member 250 includes teeth members 10*a*, 10*b* that are slightly modified from the teeth member 10 described above and shown in FIG. 1. Specifically, the extensions or protrusions 18 of the teeth member 10*a*, 10*b* have sharper edges and have a lesser height than that of the teeth member 10. In this embodiment, as shown in FIG. 25, the transverse proximal end 260 of the head member 250 includes teeth member 10*a* having a channel 22 aligned thereto. That is, the pair of extensions 18 extend from the transverse proximal end 260 substantially parallel thereto. Similarly, as shown in FIG. 26, the transverse distal end 258 of the head member 250 includes teeth member 10*b* having a channel 22 aligned thereto. That is, the pair of extensions 18 extend from the transverse distal end 258 substantially parallel thereto. Although the teeth member 10*a*, 10*b* are similar in geometry, the rear teeth member 10*b* is smaller in diameter and the flanges 16 are closer together, i.e., the grooves 14 are narrower. The rear teeth member 10*b* have smaller teeth, which are sharper and more aggressive on the cleaning surface. As such, the rear teeth member 10*b* is more suitable for a deeper clean on harder fabric. The front teeth member 10*a* is softer than the rear teeth member 10*b* and is more suitable for cleaning a fluffier or softer surface.

Still referring to FIGS. 18-26, with this configuration, the user has two separate options on a single device. That is, in use, when cleaning a harder surface, the user utilizes the rear teeth member 10*b* by engaging the ends of the flange extensions 18 with the cleaning surface and pulls the handle 256 toward the user to collect debris. When cleaning a softer surface, the user utilizes the front teeth member 10*a* by engaging the ends of the flange extensions 18 with the cleaning surface and pulls the handle 256 toward the user to collect debris.

The head member 250 is constructed of plastic and is integrally formed via injection molding. However, other materials such as metal and composite materials could be used, and the base member 252, support member 254 and extension member 256 could also be manufactured separately and attached together by various methods such as welding, adhesives or fasteners.

In the embodiment shown in FIGS. 10-12, the extension member 256 is tubular for receiving an extendable handle member 268. The extension member 256 includes opposing and aligned apertures 270 for securing the handle member 268 to the extension member 256 via known methods such as with a fastener 272 or spring-loaded pin. The handle member 268 includes a pair of telescoping tubes 274, 276 which are locked and unlocked with a threaded locking mechanism 278. The handle member 268 is constructed of metal due to its durability but other materials such as plastic and composite materials could be used.

Alternatively, the handle member 268 could be constructed more than two tubes and coupled together with internal threads and further secured to each other with fasteners extending through apertures machined through adjacent tubes. In this manner, the handle member is further reinforced so that the handle member is capable of withstanding force during use. Although not specifically shown in FIGS. 18-26, the head member 250 in that embodiment could also be constructed with a similar extension member 256 and handle members as described above.

In an alternative embodiment, the extension member 256 could be formed as or include a handle, or simply used as a handle, so that the cleaning device could be used without the extended handle member 268. This could be particularly useful for cleaning in smaller spaces such as automobile interiors where an extended handle is not feasible due to the limited space.

Figure 14:
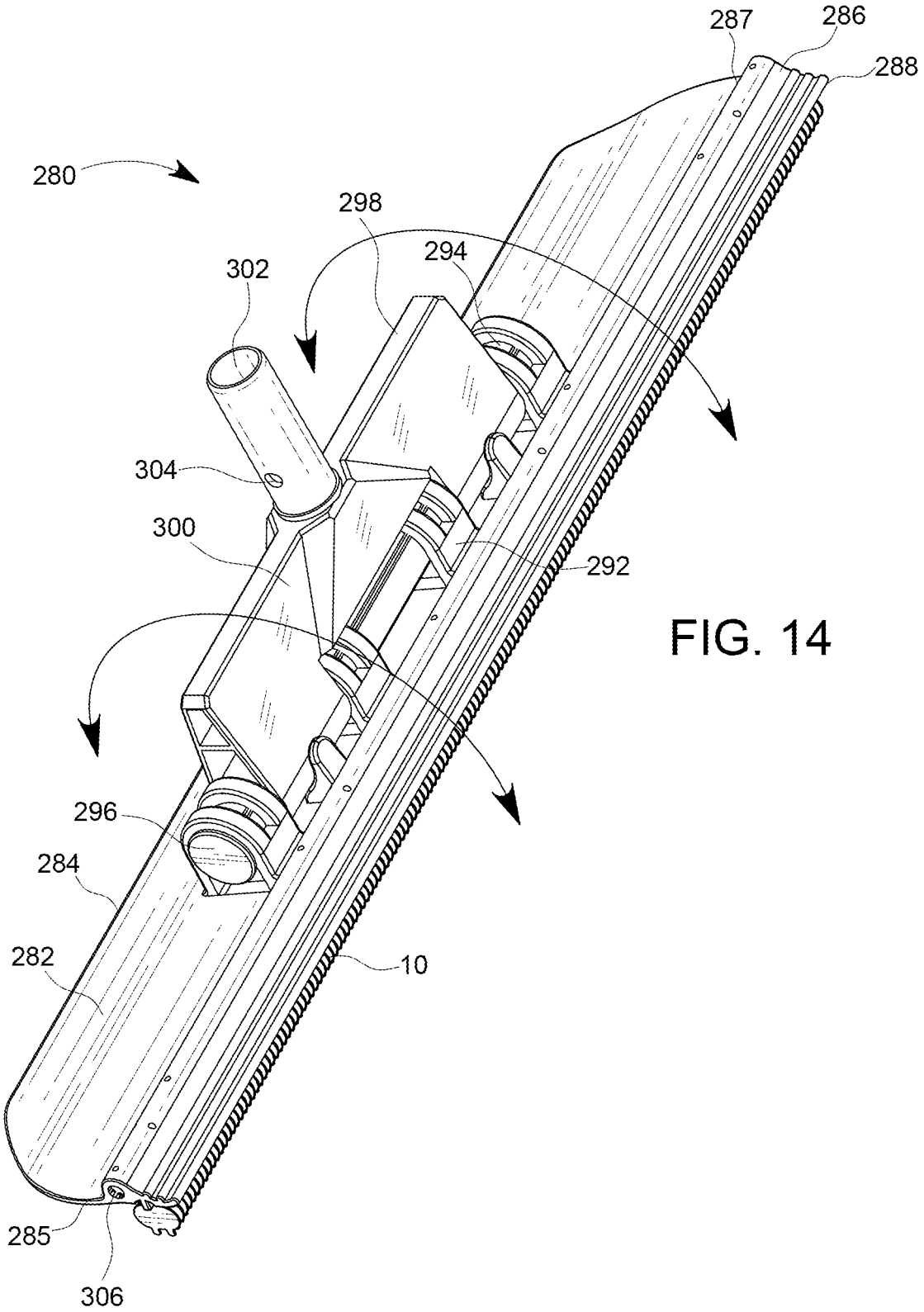
FIGS. 14 and 15 are illustrations of an adjustment mechanism of the head member of FIG. 13.
Figure 15:
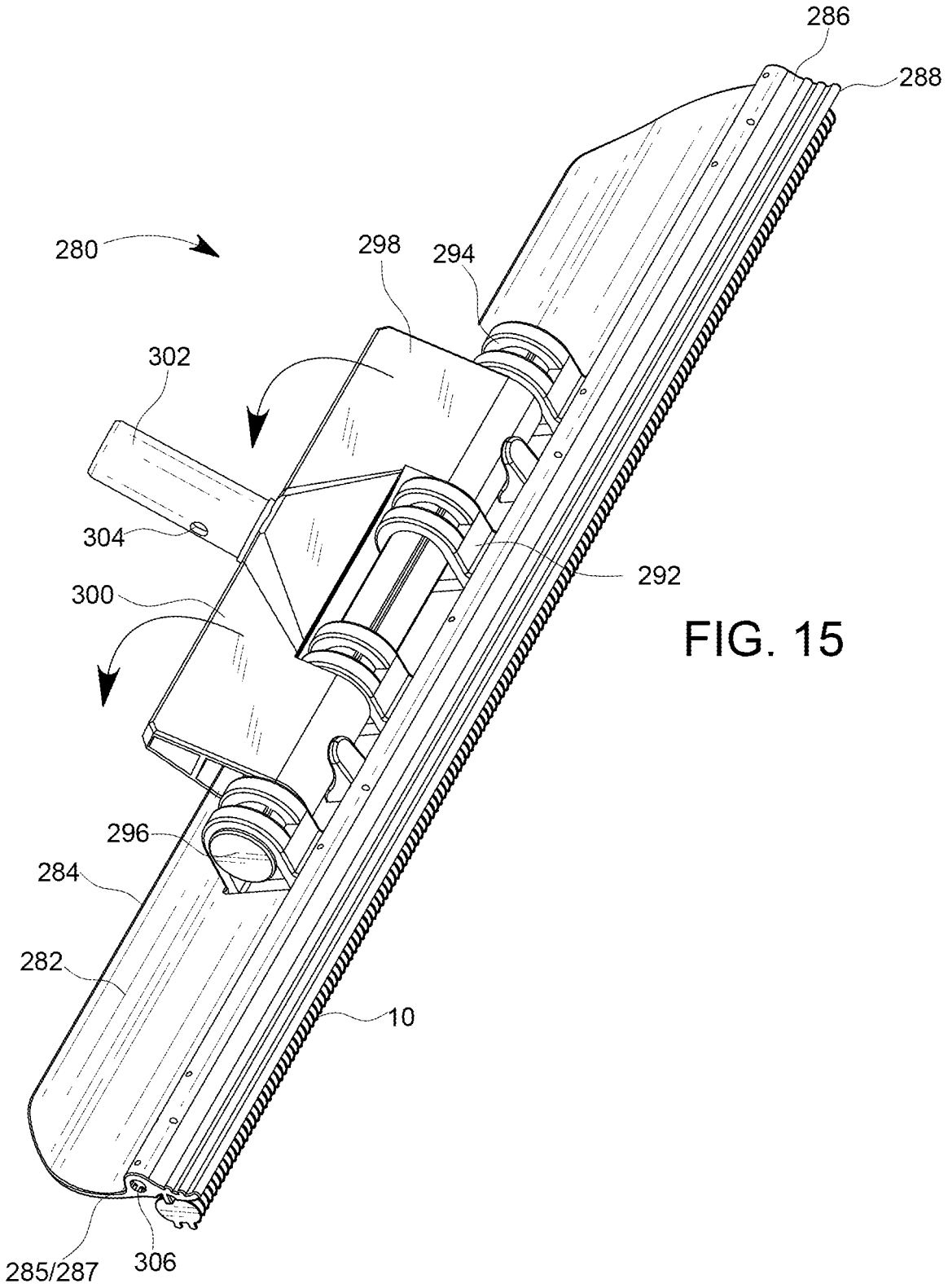
Figure 16:
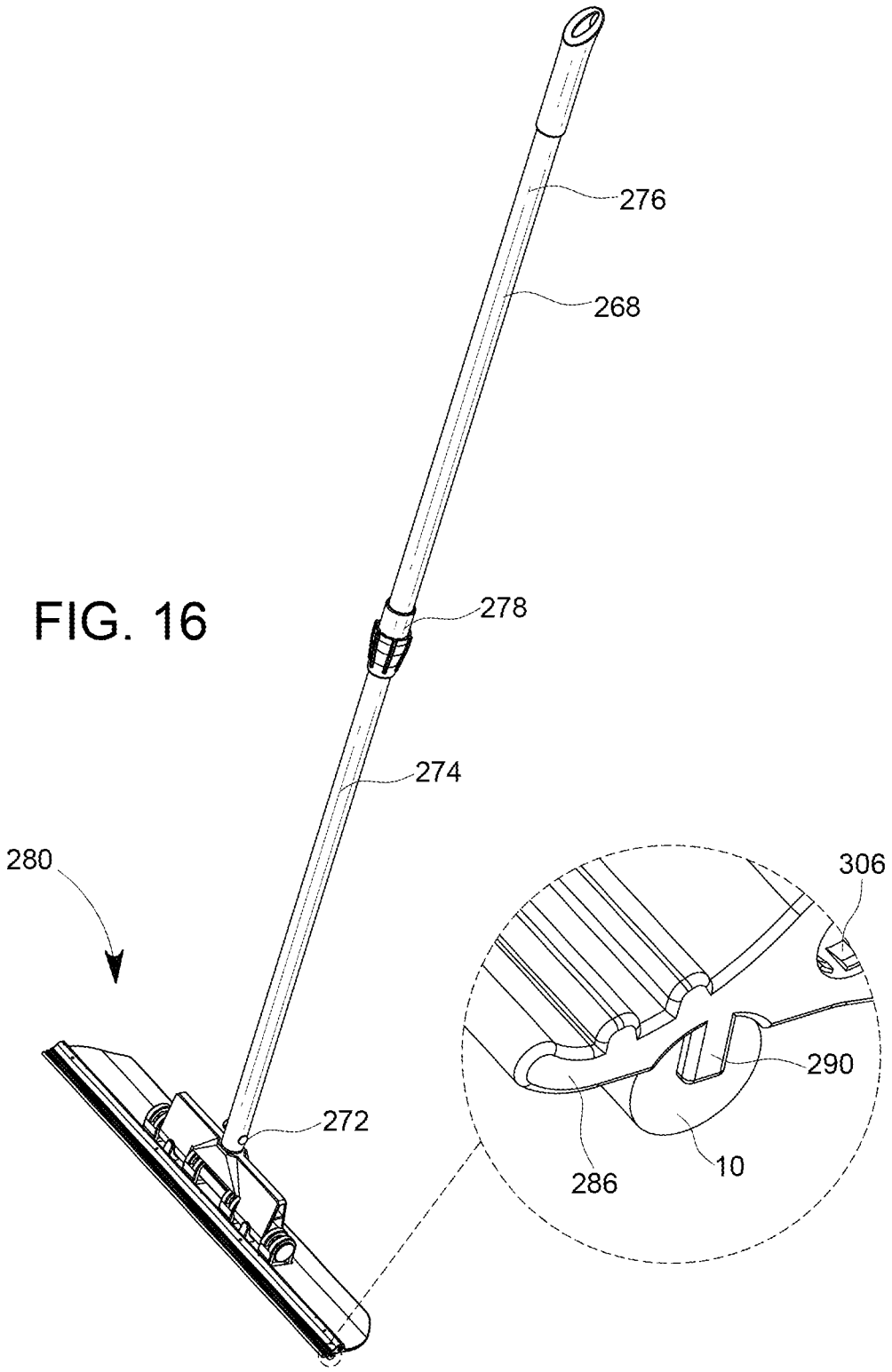
FIGS. 16 and 17 are side perspective and bottom perspective views, respectively, of the head member of FIG. 13 attached to a handle member, with an illustrated detailed view of an end thereof.
Figure 17:
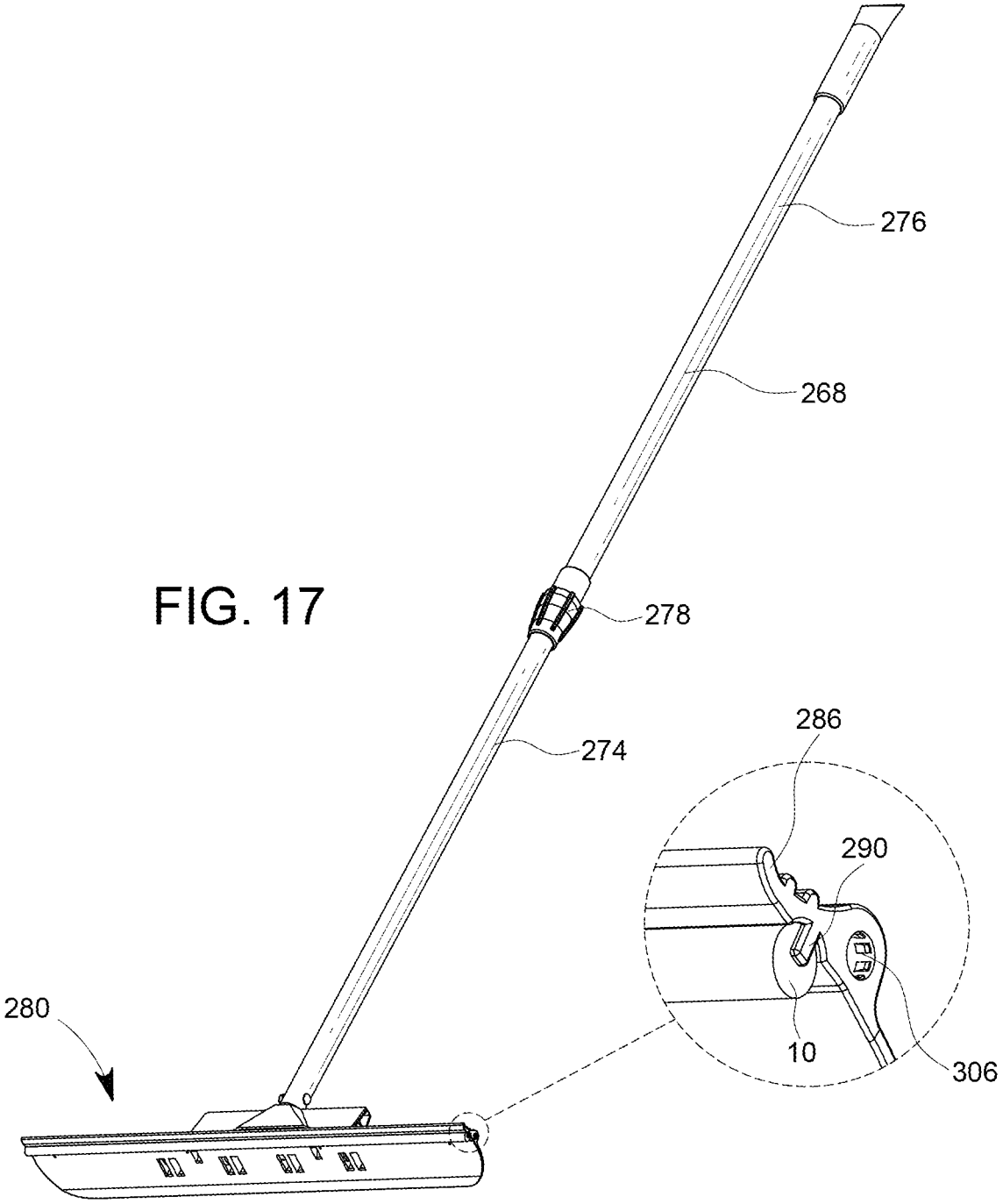
Figure 18:
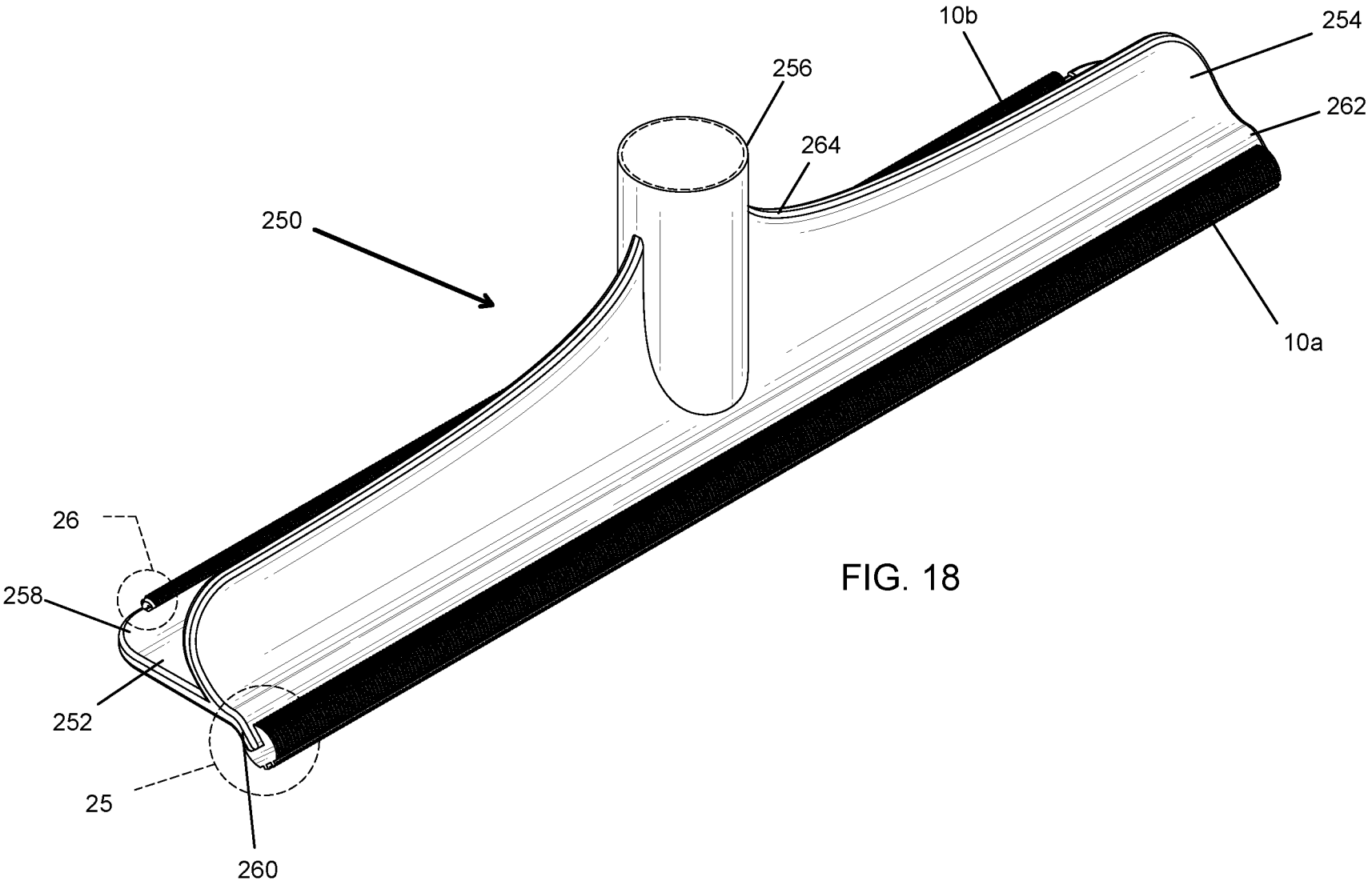
FIG. 18 is a perspective view of an alternative embodiment of the head member shown in FIG. 11.
Figure 19:
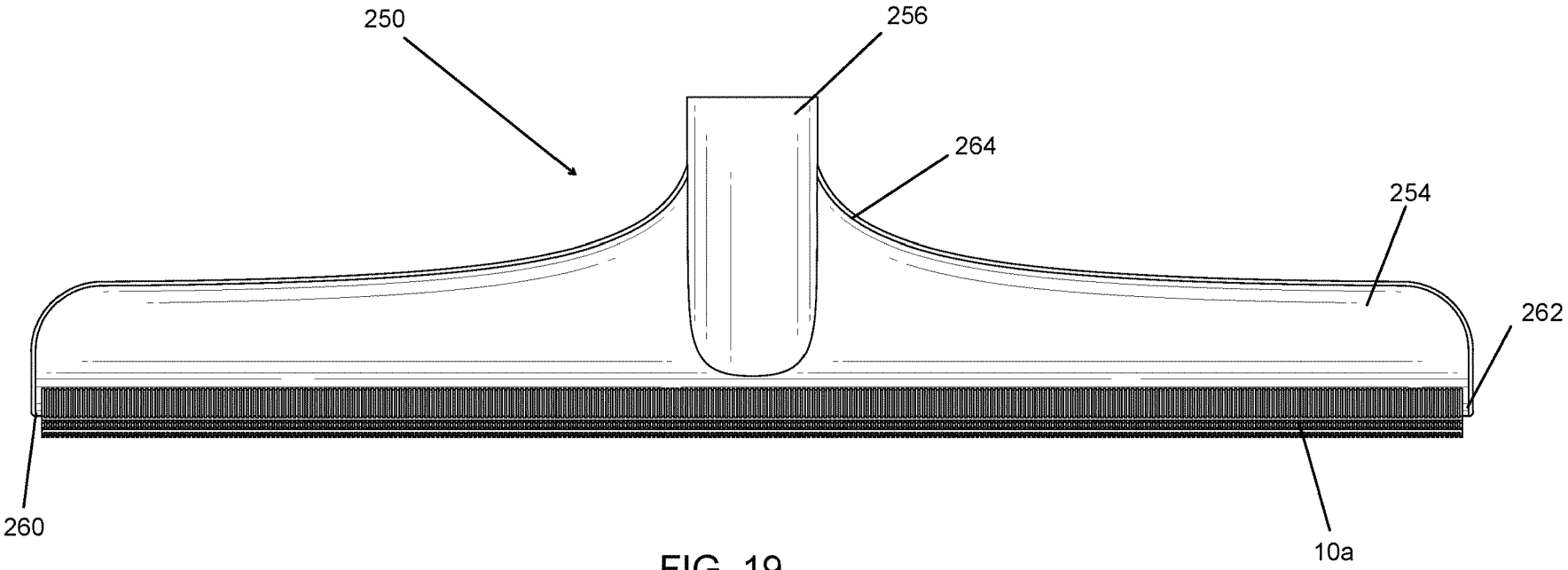
FIG. 19 is a front view of the head member of FIG. 18.
Figure 20:
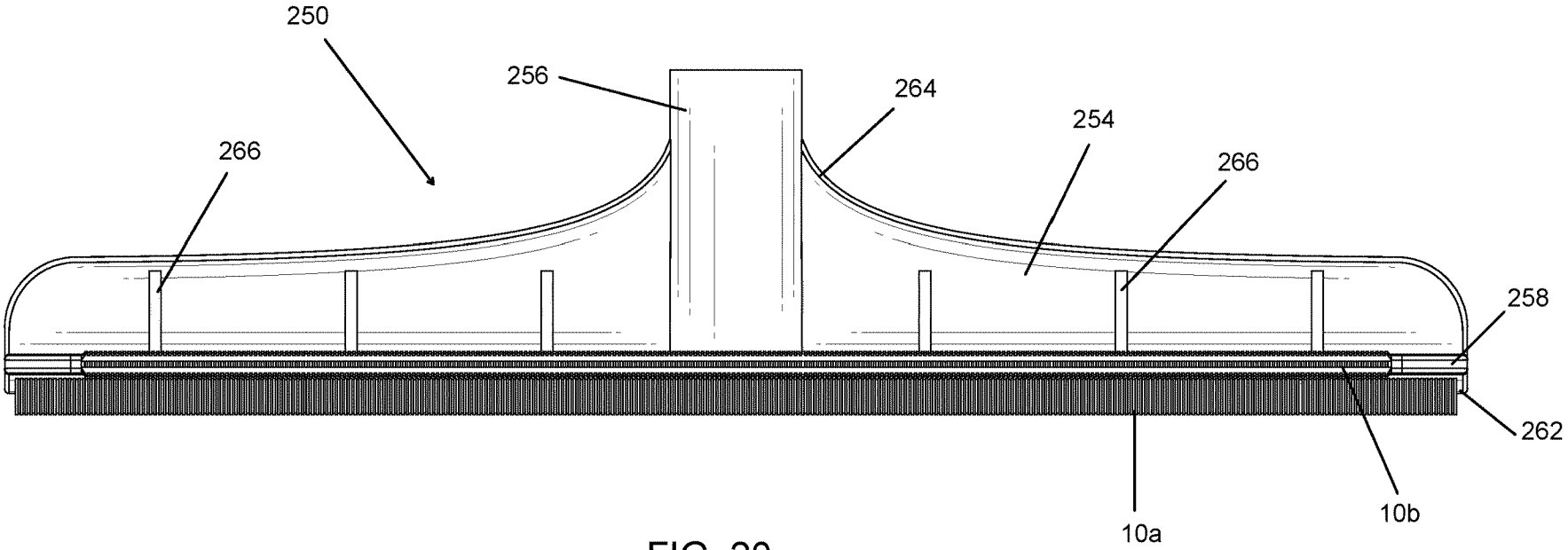
FIG. 20 is a rear view of the head member of FIG. 18.
Figure 21:
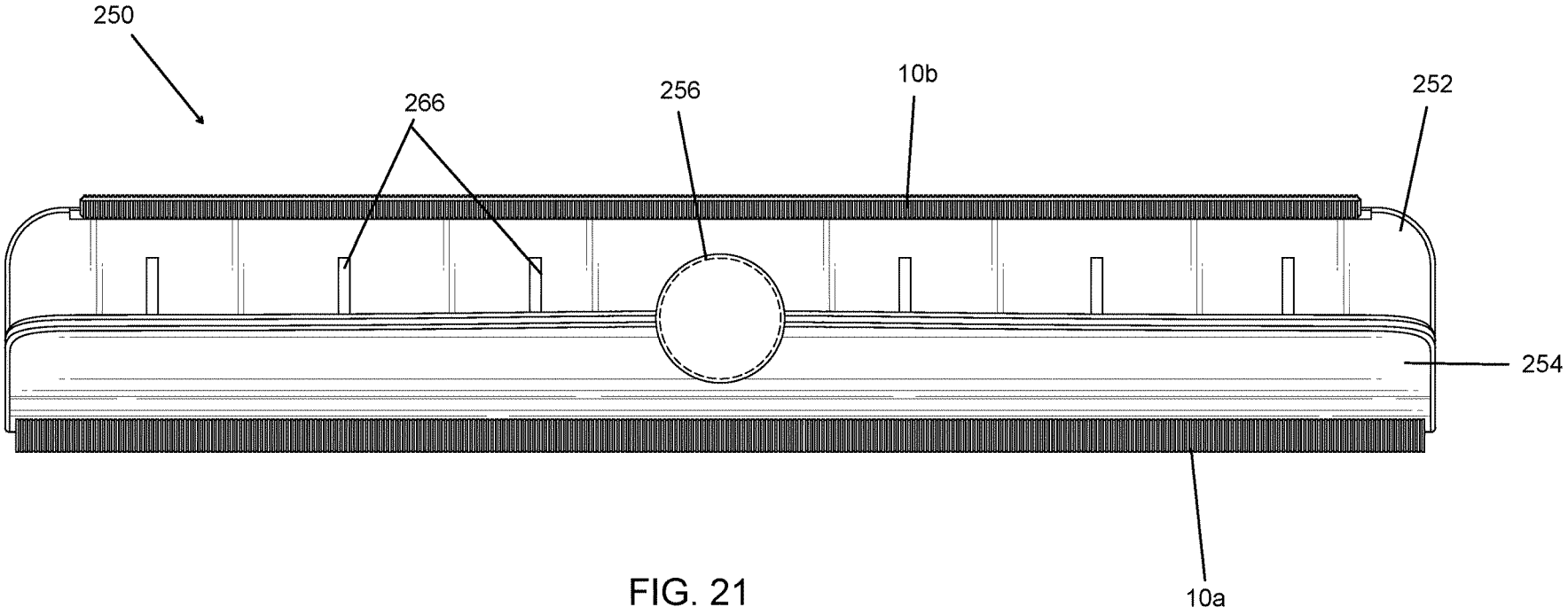
FIG. 21 is a top view of the head member of FIG. 18.
Figure 22:
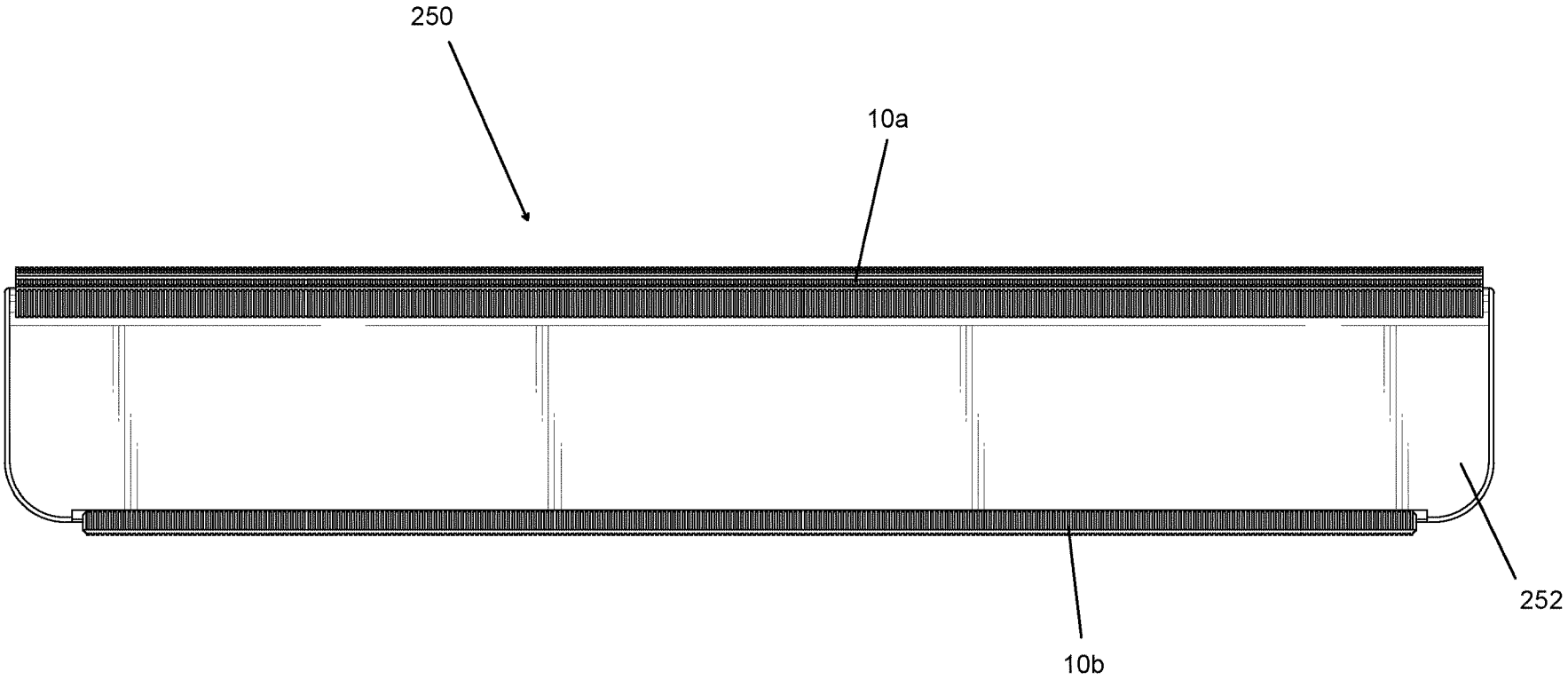
FIG. 22 is a bottom view of the head member of FIG. 18.
Figure 23:
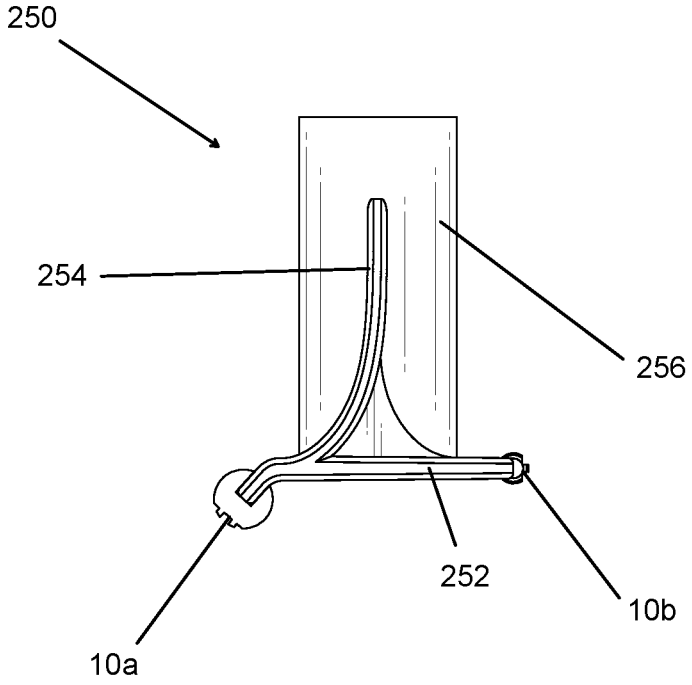
FIG. 23 is a right side view of the head member of FIG. 18.
Figure 24:
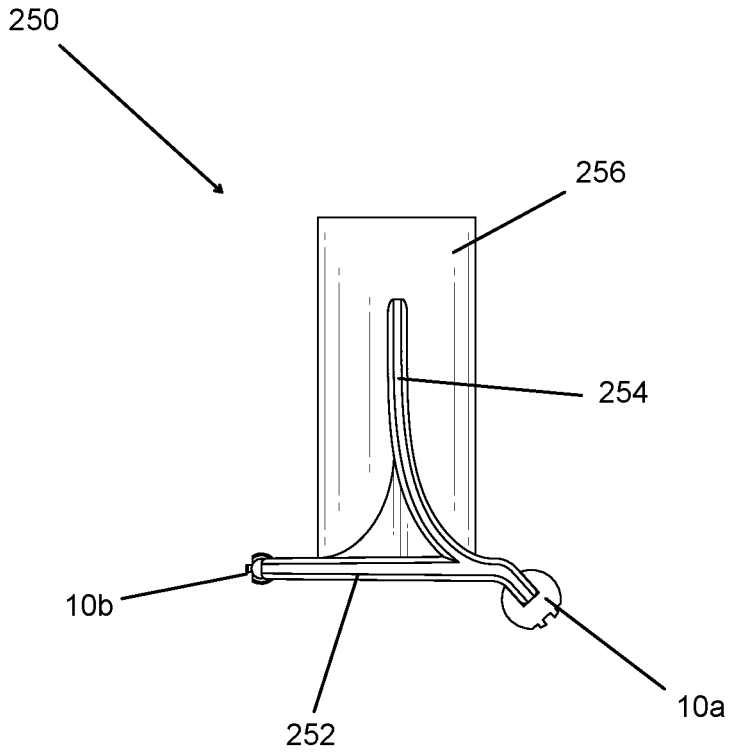
FIG. 24 is a left side view of the head member of FIG. 18.

Referring to FIGS. 13-17, a second embodiment of a head member 280 of the present invention is shown. The head member 280 extends longitudinally and includes a curved base member 282 having an upwardly extending distal end 284 and an opposing substantially flat proximal end 285 extending transversely. The head member 280 is integrally formed with a support member 286, which extends transversely from a proximal end 287 to a distal free end 288, opposite the base member distal end 284. The support member distal end 288 includes a downwardly extending engagement member 290 which extends longitudinally along the support member 286. The engagement member 290 is sized and shaped to receive, via snap-fit or form-fit, a top channel 20, 38 of the teeth member 10, 30. Alternatively, the teeth member 10, 30 could be attached to the engagement member 290 by other methods such as adhesives, fasteners and welding. A housing member 292 is integrally formed on the base member 282 between the base member distal and proximal ends 285, 287. The housing member 292 includes opposing housing apertures 294 for receiving a plastic rotating shaft 296 which is rotatably coupled therein. In the alternative, the rotating shaft 296 could be constructed of other materials, including metal. An extension member 298 is fixedly coupled to the rotating shaft 296 such that the extension member 298 is pivotable about the shaft 296 based on the rotation of the shaft 296. The housing member 292 includes a locking mechanism (not shown) for restricting the rotation of the shaft 296. The extension member 298 includes a lower member 300 extending upwardly from the shaft 296, and a tubular receiving member 302 integrally formed and extending upwardly from the lower member 300. The receiving member 302 includes opposing and aligned apertures 304 for securing the handle member 268 via known methods such as with a fastener 272, as shown in FIGS. 16 and 17, or spring-loaded pins.

Referring to FIGS. 14 and 15, as indicated by the arrows, the extension member 298 is configured to rotate in either direction from the perpendicular or upright position shown in FIG. 14. Preferably, the shaft 296 is configured so that the extension member 298 is capable of rotating to a position parallel to the base member 282 away from the teeth member 10 to a position 30 degrees from the perpendicular or upright position toward the teeth member 10. However, one of ordinary skill in the art will recognize that the rotatable positions could be adjusted without departing from the spirit and scope of the invention.

As shown in FIGS. 13-17, preferably, the head member 280 is configured such that the teeth member 10 is positioned away from the user. In use, the teeth member 10 is engaged with the cleaning surface and the user pulls the head member 280 toward the user. This embodiment is particularly advantageous because there is no need for the user need not adjust the angle of attack as the flange extensions or lips 18 of the teeth member 10 will always be perpendicular to the cleaning surface due to the pivoting extension member 298.

The base member 282, support member 286 and housing member 292 is constructed of plastic and is integrally formed via injection molding. Similarly, the rotating shaft 296 and extension member 298 are constructed of plastic and separately formed by injection molding. However, other materials such as metal and composite materials could be used, and the components of the head member 280 could also be manufactured separately and attached together by various methods such as welding, adhesives or fasteners.

Referring to FIGS. 13-16, optionally, the head member 280 is provided with a reinforcement aperture 306 which extends longitudinally along the length of the head member 280. A metal rod (not shown) could be inserted in the reinforcement aperture 306 for further stability and to prevent deformation of the head member 280.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. It is also to be understood that the following claims are intended to cover all of the generic and specific features of the invention herein described, and all statements of the scope of the invention that, as a matter of language, might be said to fall there between.

The invention claimed is:

1. A cleaning device comprising:

a base member extending in a longitudinal direction between a first distal end and a first proximal end and a width extending normal to the longitudinal direction, the first proximal end of the base member being at an angle relative to the first distal end of the base member;

a support member extending longitudinally between a second distal end and a second proximal end, the second proximal end integrally formed with the first proximal end of the base member, and the second distal end of the support member extending at an upward angle with respect to the base member;

at least one support flange coupling the base member and the support member;

an extension member extending from the second distal end of the support member and integrally formed therewith, the extension member being positioned orthogonal with respect to the base member; and at least one teeth member comprising a contact surface and an attachment surface, the attachment surface formed with an inner channel extending along the width of the base member, the inner channel coupled with one of the first distal end and the first proximal end of the base member, the contact surface having outer flanges with an outer channel formed therein, the outer channel extending along the width and positioned opposite the inner channel;

wherein the contact surface is adapted to come in contact with a cleaning surface such that the outer flanges penetrate the cleaning surface to dislodge and collect debris.

2. The cleaning device according to claim 1, wherein the attachment surface includes a pair of inner flange extensions and the inner channel is formed therebetween.

3. The cleaning device according to claim 1, wherein the contact surface includes a pair of outer flange extensions and the outer channel is formed therebetween.

4. The cleaning device according to claim 1, wherein the inner channel is coupled with the one of the first distal end and the first proximal end by friction fit.

5. The cleaning device according to claim 1, wherein the inner channel is coupled with the one of the first distal end and the first proximal end by an adhesive.

6. The cleaning device according to claim 1, wherein the at least one teeth member comprises two teeth members, the inner channel of each teeth member coupled to the first distal end and the first proximal end.

7. The cleaning device according to claim 1, further comprising a handle member extending from the extension member.

8. A cleaning device comprising:

a base member extending longitudinally between a first distal end and a first proximal end;

a support member extending longitudinally between a second distal end and a second proximal end, the support member being positioned at an upwardly extending angle with respect to the base member;

at least one support flange coupling the base member and the support member;

an extension member extending from the second distal end of the support members wherein the extension member is positioned orthogonal to the base member; and at least one teeth member comprising a contact surface and an attachment surface, the attachment surface formed with an inner channel, the inner channel coupled with the base member proximate one of the first distal end and the first proximal end, the contact surface having outer flanges with an outer channel formed therein, the outer channel positioned opposite the inner channel;

wherein the contact surface is adapted to come in contact with a cleaning surface such that the outer flanges penetrate the cleaning surface to dislodge and collect debris.

9. The cleaning device according to claim 8, wherein the attachment surface includes a pair of inner flange extensions and the inner channel is formed therebetween.

10. The cleaning device according to claim 8, wherein the contact surface includes a pair of outer flange extensions and the outer channel is formed therebetween.

11. The cleaning device according to claim 8, wherein the at least one teeth member comprises two teeth members, the inner channel of each teeth member coupled to the first distal end and first proximal end.

12. The cleaning device according to claim 8, wherein the first proximal end of the base member is at an angle relative to the first distal end of the base member.

13. The cleaning device according to claim 8, wherein the second proximal end is integrally formed with the first proximal end of the base member.

14. A cleaning device comprising:

a base member extending longitudinally between a first distal end and a first proximal end;

a support member extending longitudinally between a second distal end and a second proximal end, the support member being positioned at an upwardly extending angle with respect to the base member;

an extension member extending from the second distal end of the support member, wherein the extension member is positioned orthogonal to the base member; and at least one teeth member comprising a contact surface and an attachment surface, the attachment surface formed with an inner channel, the inner channel coupled with the base member proximate one of the first distal end and the first proximal end, the contact surface having outer flanges with an outer channel formed therein, the outer channel positioned opposite the inner channel;

wherein the contact surface is adapted to come in contact with a cleaning surface such that the outer flanges penetrate the cleaning surface to dislodge and collect debris.

15. The cleaning device according to claim 14, wherein the attachment surface includes a pair of inner flange extensions and the inner channel is formed therebetween.

16. The cleaning device according to claim 14, wherein the contact surface includes a pair of outer flange extensions and the outer channel is formed therebetween.

17. The cleaning device according to claim 14, wherein the at least one teeth member comprises two teeth members, the inner channel of each teeth member coupled to the first distal end and the first proximal end.

18. The cleaning device according to claim 14, wherein the first proximal end of the base member is at an angle relative to the first distal end of the base member.

19. The cleaning device according to claim 14, wherein the second proximal end is integrally formed with the first proximal end of the base member.

20. The cleaning device according to claim 14, further comprising at least one support flange coupling the base member and the support member.

* * * * *